US008511232B2

(12) United States Patent
Scarr

(10) Patent No.: US 8,511,232 B2
(45) Date of Patent: Aug. 20, 2013

(54) MULTIFIRE LESS LETHAL MUNITIONS

(76) Inventor: Kimball Rustin Scarr, Connersville, IN (US)

( * ) Notice: Subject to any disclaimer, the term of this patent is extended or adjusted under 35 U.S.C. 154(b) by 0 days.

(21) Appl. No.: 13/158,093

(22) Filed: Jun. 10, 2011

(65) Prior Publication Data

US 2012/0180361 A1 Jul. 19, 2012

Related U.S. Application Data

(60) Provisional application No. 61/353,637, filed on Jun. 10, 2010.

(51) Int. Cl.
*F42B 10/36* (2006.01)

(52) U.S. Cl.
USPC ..... 102/503; 102/502

(58) Field of Classification Search
USPC ..... 102/502, 513, 520, 430, 438, 503, 102/444, 498, 501; 89/1.701, 14.6; 124/73
See application file for complete search history.

(56) References Cited

U.S. PATENT DOCUMENTS

| | | | |
|---|---|---|---|
| 2,115,028 | A | 4/1938 | Orwell |
| 2,784,711 | A | 3/1957 | Vaughn |
| 2,918,006 | A | 12/1959 | VonZborowski |
| 3,264,776 | A | 8/1966 | Morrow |
| 3,340,769 | A | 9/1967 | Waser |
| 3,400,661 | A | 9/1968 | Coon |
| 3,415,193 | A | 12/1968 | Campagnuolo et al. |
| 3,474,990 | A | 10/1969 | Flatau |
| 3,476,048 | A | 11/1969 | Barr |
| 3,493,199 | A | 2/1970 | Flatau |
| 3,526,377 | A | 9/1970 | Flatau |
| 3,584,581 | A | 6/1971 | Flatau et al. |
| 3,585,934 | A | 6/1971 | Mueller |
| 3,645,694 | A | 2/1972 | Flatau |
| 3,738,279 | A | 6/1973 | Eyre et al. |
| 3,837,107 | A | 9/1974 | Swaim et al. |
| 3,877,383 | A | 4/1975 | Flatau |
| 3,898,932 | A | 8/1975 | Flatau et al. |
| 3,912,197 | A | 10/1975 | McKown et al. |
| 3,919,799 | A | 11/1975 | Austin, Jr. et al. |
| 3,951,070 | A | 4/1976 | Flatau et al. |
| 3,954,057 | A | 5/1976 | Flatau |
| 3,956,844 | A | 5/1976 | Misevich et al. |

(Continued)

FOREIGN PATENT DOCUMENTS

| | | |
|---|---|---|
| EP | 0857940 | 8/2002 |
| EP | 1228342 | 7/2003 |

(Continued)

OTHER PUBLICATIONS

USPTO, NF Rejection, U.S. Appl. No. 10/803,260, Oct. 16, 2007, 7 pages.

(Continued)

*Primary Examiner* — Stephen M Johnson
*Assistant Examiner* — John D Cooper
(74) *Attorney, Agent, or Firm* — John V. Daniluck; Bingham Greenebaum Doll LLP

(57) ABSTRACT

Apparatus and methods for launching and fabricating projectiles. In some embodiments, one or more ring airfoil projectiles are launched from a gun. Yet other embodiments pertain to the launching of projectiles that disperse tracer or irritant chemicals upon impact. Yet other embodiments pertain to apparatus and methods for molding of munition components.

4 Claims, 48 Drawing Sheets

(56) References Cited

U.S. PATENT DOCUMENTS

| | | | | |
|---|---|---|---|---|
| 3,980,023 | A | 9/1976 | Misevich | |
| 3,981,093 | A | 9/1976 | Reed | |
| 3,982,489 | A | 9/1976 | Flatau et al. | |
| 4,052,927 | A | 10/1977 | Flatau et al. | |
| 4,132,148 | A | 1/1979 | Meistring et al. | |
| 4,151,674 | A | 5/1979 | Klahn et al. | |
| 4,154,012 | A * | 5/1979 | Miller | 42/105 |
| 4,164,904 | A | 8/1979 | Laviolette | |
| 4,190,476 | A | 2/1980 | Flatau et al. | |
| 4,212,244 | A | 7/1980 | Flatau et al. | |
| 4,246,721 | A | 1/1981 | Bowers | |
| 4,262,597 | A | 4/1981 | Olson | |
| 4,270,293 | A | 6/1981 | Plumer et al. | |
| 4,301,736 | A | 11/1981 | Flatau et al. | |
| 4,337,911 | A | 7/1982 | Flatau | |
| 4,390,148 | A | 6/1983 | Cudmore | |
| 4,413,565 | A | 11/1983 | Matthey et al. | |
| 4,539,911 | A | 9/1985 | Flatau | |
| 4,579,059 | A | 4/1986 | Flatau | |
| 4,612,860 | A | 9/1986 | Flatau | |
| 4,656,946 | A | 4/1987 | Gordon et al. | |
| 4,656,947 | A | 4/1987 | Gordon et al. | |
| 4,735,148 | A | 4/1988 | Holtzman | |
| 4,742,774 | A | 5/1988 | Flatau | |
| 4,753,152 | A * | 6/1988 | Baechler | 89/1.701 |
| 4,776,281 | A | 10/1988 | Chiang et al. | |
| 4,790,788 | A | 12/1988 | Hill | |
| 4,827,847 | A | 5/1989 | Laviolette et al. | |
| 4,850,923 | A | 7/1989 | Etheridge | |
| 4,882,997 | A | 11/1989 | Baxter et al. | |
| 4,936,218 | A | 6/1990 | Wosenitz | |
| 4,938,146 | A | 7/1990 | Gunther | |
| 4,969,397 | A | 11/1990 | Gunther | |
| H0000942 | H | 8/1991 | Pardee | |
| 5,067,406 | A | 11/1991 | Olson et al. | |
| 5,275,110 | A | 1/1994 | Flatau | |
| 5,303,632 | A | 4/1994 | Kivity | |
| 5,317,866 | A | 6/1994 | Murray et al. | |
| 5,377,656 | A | 1/1995 | Lewinski et al. | |
| 5,397,261 | A | 3/1995 | Malewicki et al. | |
| 5,515,787 | A | 5/1996 | Middleton | |
| 5,526,749 | A | 6/1996 | Teetzel | |
| 5,531,210 | A | 7/1996 | Meiser et al. | |
| 5,535,729 | A | 7/1996 | Griffin et al. | |
| 5,546,845 | A | 8/1996 | Wossner | |
| 5,655,947 | A | 8/1997 | Chen | |
| 5,677,505 | A | 10/1997 | Dittrich | |
| 5,747,719 | A | 5/1998 | Bottesch | |
| 5,816,880 | A | 10/1998 | Forti et al. | |
| 5,868,597 | A | 2/1999 | Chen | |
| 5,936,189 | A | 8/1999 | Lubbers | |
| 5,970,970 | A | 10/1999 | Vanek | |
| 6,041,712 | A | 3/2000 | Lyon | |
| 6,076,511 | A | 6/2000 | Grimm et al. | |
| 6,079,398 | A | 6/2000 | Grimm | |
| 6,083,127 | A | 7/2000 | O'Shea | |
| 6,145,441 | A | 11/2000 | Woodall et al. | |
| 6,152,123 | A | 11/2000 | Ferrante et al. | |
| 6,178,889 | B1 | 1/2001 | Dindl | |
| 6,220,918 | B1 | 4/2001 | Laronge | |
| 6,257,146 | B1 | 7/2001 | Stonebraker | |
| 6,298,788 | B1 | 10/2001 | Woods | |
| 6,324,983 | B1 | 12/2001 | Dindl | |
| 6,324,984 | B1 | 12/2001 | Dindl | |
| 6,374,741 | B1 | 4/2002 | Stanley | |
| 6,454,623 | B1 | 9/2002 | Flatau | |
| 6,564,719 | B2 | 5/2003 | Saxby | |
| 6,575,098 | B2 | 6/2003 | Hsiung | |
| 6,599,161 | B2 | 7/2003 | Hunter | |
| 6,647,890 | B2 | 11/2003 | Findlay | |
| 6,671,989 | B2 | 1/2004 | Vanek et al. | |
| 6,722,252 | B1 | 4/2004 | O'Dwyer | |
| 6,722,283 | B1 | 4/2004 | Dindl | |
| 6,742,509 | B2 | 6/2004 | Hunter et al. | |
| 6,782,828 | B2 | 8/2004 | Widener | |
| 6,782,829 | B1 | 8/2004 | Han | |
| 6,832,557 | B2 | 12/2004 | Torsten | |
| 6,860,187 | B2 | 3/2005 | O'Dwyer | |
| 6,915,793 | B2 | 7/2005 | Vanek et al. | |
| 6,953,033 | B2 | 10/2005 | Vanek et al. | |
| 6,983,700 | B1 | 1/2006 | Malejko | |
| 6,990,905 | B1 | 1/2006 | Manole | |
| 7,004,074 | B2 | 2/2006 | Van Stratum | |
| 7,007,424 | B2 | 3/2006 | Vanek et al. | |
| 7,021,219 | B1 | 4/2006 | Dindl | |
| D522,070 | S | 5/2006 | Hunter et al. | |
| 7,063,082 | B2 | 6/2006 | Vanek et al. | |
| 7,089,863 | B1 | 8/2006 | Dindl | |
| 7,165,496 | B2 | 1/2007 | Reynolds | |
| 7,191,708 | B2 | 3/2007 | Ouliarin | |
| 7,207,273 | B2 | 4/2007 | Brunn | |
| 7,207,276 | B1 | 4/2007 | Dindl | |
| 7,287,475 | B2 | 10/2007 | Brunn | |
| 7,377,204 | B2 | 5/2008 | Simmons | |
| 7,418,896 | B1 | 9/2008 | Dindl | |
| 7,430,825 | B2 | 10/2008 | Vanek et al. | |
| 7,444,941 | B1 | 11/2008 | Brunn | |
| 7,451,702 | B1 | 11/2008 | Dindl | |
| 7,475,638 | B2 | 1/2009 | Haeselich | |
| 7,500,434 | B2 | 3/2009 | Flatau et al. | |
| 7,503,521 | B2 | 3/2009 | Maynard | |
| 7,549,376 | B1 | 6/2009 | Grossman | |
| 7,568,433 | B1 | 8/2009 | Farina | |
| 7,581,500 | B2 | 9/2009 | Flatau | |
| 7,621,208 | B2 | 11/2009 | Huffman | |
| 7,654,458 | B1 | 2/2010 | Kokodis | |
| 7,658,151 | B2 | 2/2010 | Genis | |
| 7,681,503 | B1 | 3/2010 | Fridley | |
| 7,690,310 | B2 | 4/2010 | Engel | |
| 7,793,591 | B1 | 9/2010 | Van Stratum | |
| 7,802,520 | B2 | 9/2010 | Van Stratum | |
| 7,819,065 | B2 | 10/2010 | Haeselich | |
| 7,823,509 | B2 | 11/2010 | Dindl | |
| 8,065,961 | B1 * | 11/2011 | Scarr | 102/503 |
| 2002/0088367 | A1 | 7/2002 | MacAleese | |
| 2003/0000122 | A1 | 1/2003 | Vanek et al. | |
| 2003/0089221 | A1 | 5/2003 | O'Dwyer | |
| 2003/0097952 | A1 | 5/2003 | Findlay | |
| 2004/0000250 | A1 | 1/2004 | Stratum | |
| 2005/0066843 | A1 | 3/2005 | Flatau et al. | |
| 2005/0183615 | A1 | 8/2005 | Flatau | |
| 2006/0096492 | A1 | 5/2006 | Flatau et al. | |
| 2007/0079819 | A1 * | 4/2007 | Vanek et al. | 124/16 |
| 2008/0006171 | A1 | 1/2008 | Confer | |
| 2008/0223246 | A1 | 9/2008 | Dindl | |
| 2010/0089226 | A1 | 4/2010 | Jones | |
| 2010/0095863 | A1 | 4/2010 | Kolnik | |
| 2010/0101443 | A1 | 4/2010 | Rosales | |
| 2010/0132580 | A1 | 6/2010 | Nazdratenko | |
| 2010/0212533 | A1 | 8/2010 | Brunn | |
| 2010/0263568 | A1 | 10/2010 | Huffman | |
| 2010/0282118 | A1 | 11/2010 | Ladyjensky | |

FOREIGN PATENT DOCUMENTS

| | | |
|---|---|---|
| EP | 1376046 | 1/2004 |
| EP | 1104541 | 3/2004 |
| EP | 0966650 | 9/2005 |
| EP | 1079199 | 10/2005 |
| WO | 8101046 | 4/1981 |
| WO | 8707708 | 12/1987 |
| WO | 9853269 | 11/1998 |
| WO | 9937968 | 7/1999 |
| WO | 2006083280 | 8/2006 |
| WO | 2006092637 | 9/2006 |
| WO | 2008020857 | 2/2008 |
| WO | 2008045131 | 4/2008 |
| WO | 2008099353 | 8/2008 |
| WO | 2009048664 | 4/2009 |
| WO | 2009137370 | 11/2009 |

OTHER PUBLICATIONS

USPTO, NF Rejection, U.S. Appl. No. 12/045,647, Jun. 11, 2010, 29 pages.

Applicant Response, U.S. Appl. No. 12/045,647, Dec. 13, 2010, 38 pages.
USPTO, Notice of Allowance, U.S. Appl. No. 12/045,647, Mar. 21, 2011, 5 pages.
USPTO, U.S. Appl. No. 12/181,190, Oct. 4, 2010, 8 pages.
Applicant Response, U.S. Appl. No. 12/181,190, Apr. 4, 2011, 36 pages.
NF Rejection, U.S. Appl. No. 12/342,915, Dec. 3, 2010, 5 pages.
Applicant Response, U.S. Appl. No. 12/342,915, May 3, 2011, 16 pages.
USPTO, Notice of Allowance, Jul. 26, 2011, 5 pages.
USPTO, NF Rejection, U.S. Appl. No. 13/189,147, Apr. 6, 2012, 5 pages.
Applicant Response, U.S. Appl. No. 13/189,147, Jul. 31, 2012, 15 pages.
Notice of Allowance, U.S. Appl. No. 13/189,147, Aug. 10, 2012, 6 pages.

* cited by examiner

MULTIFIRE LESS LETHAL MUNITIONS

CROSS REFERENCE TO RELATED APPLICATION

This application claims the benefit of priority to U.S. Provisional Patent Application Ser. No. 61/353,637, filed Jun. 10, 2010, titled MULTIFIRE LESS LETHAL MUNITIONS, incorporated herein by reference.

FIELD OF THE INVENTION

The present invention pertains to ammunition and in particular to less lethal munitions and further to ring airfoil projectiles capable of delivering payloads.

BACKGROUND OF THE INVENTION

Blunt trauma less-lethal weapons such as rubber bullets are typically fired one at a time. In some situations, this does not represent the exercise of sufficient fire power, especially when dealing with a crowd of people, and especially when fired from a single shot device such as an M203. Further, blunt trauma less-lethal devices benefit from being fired within a specific predetermined range of launching velocities. Velocities that are too high can inflict lethal and/or permanent injuries. Velocities that are too low can result in an ineffective deterrence to the target.

What is needed are apparatus and methods that can improve the firing rate of less lethal munitions, and also launch those munitions under controlled conditions. Various embodiments of the present invention accomplish some of these benefits.

SUMMARY OF THE INVENTION

One aspect of the present invention pertains to embodiments including munitions that propel multiple less lethal projectiles when fired.

Yet other aspects of some embodiments pertain to less lethal projectiles retained within a housing.

Yet other aspects of some embodiments of the present invention pertain to methods for fabricating injection molded components. In one embodiment there are methods for molding of ring shaped devices, including ring airfoil projectiles and sabots. Yet other embodiments pertain to overmolding of a plastic housing on the outer diameter of a rod.

Yet other aspects of some embodiments pertain to ring airfoil projectiles that contain compounds that are released when the projectile hits a target. Some of these compounds include irritants (such as pepper spray) and marking chemicals. Yet other embodiments include compounds carried internally by the ring airfoil projectile that emit light so as to provide a visible tracer of the trajectory of the fired projectile.

One aspect of the present invention pertains to a munition. One embodiment further includes a sabot. Another embodiment includes a retainer. Yet other embodiments include a first projectile and a second projectile located between the sabot and retainer, each projectile having a forward end and an aft end, with the forward end of the first projectile being in contact with the retainer, and the aft end of said second projectile being in contact with the sabot.

Another aspect of the present invention pertains to a projectile. One embodiment further includes a ring shaped member, the member having a leading edge and a trailing edge; wherein the leading edge is adapted and configured to securely couple with the trailing edge of another projectile.

Yet another aspect of the present invention pertains to a method of launching a projectile. One embodiment further includes providing a source of compressed gas, a projectile, a guide having a length and including an aperture for fluid flow, and a sabot movable along the length of the guide. Other embodiments include releasing compressed gas into a volume bounded in part by a surface of the sabot, propelling the sabot along the guide, and pushing the projectile by the sabot. Still other embodiments include venting gas through the aperture and stopping the sabot along the length of the guide.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions. Further, some of the figures shown herein may have been created from scaled drawings or from photographs that are scalable. It is understood that such dimensions, or the relative scaling within a figure, are by way of example, and not to be construed as limiting.

FIG. 18 shows the projectile from FIG. 19 exiting the bore, along with other debris.

DESCRIPTION OF THE PREFERRED EMBODIMENT

Figure 1A:
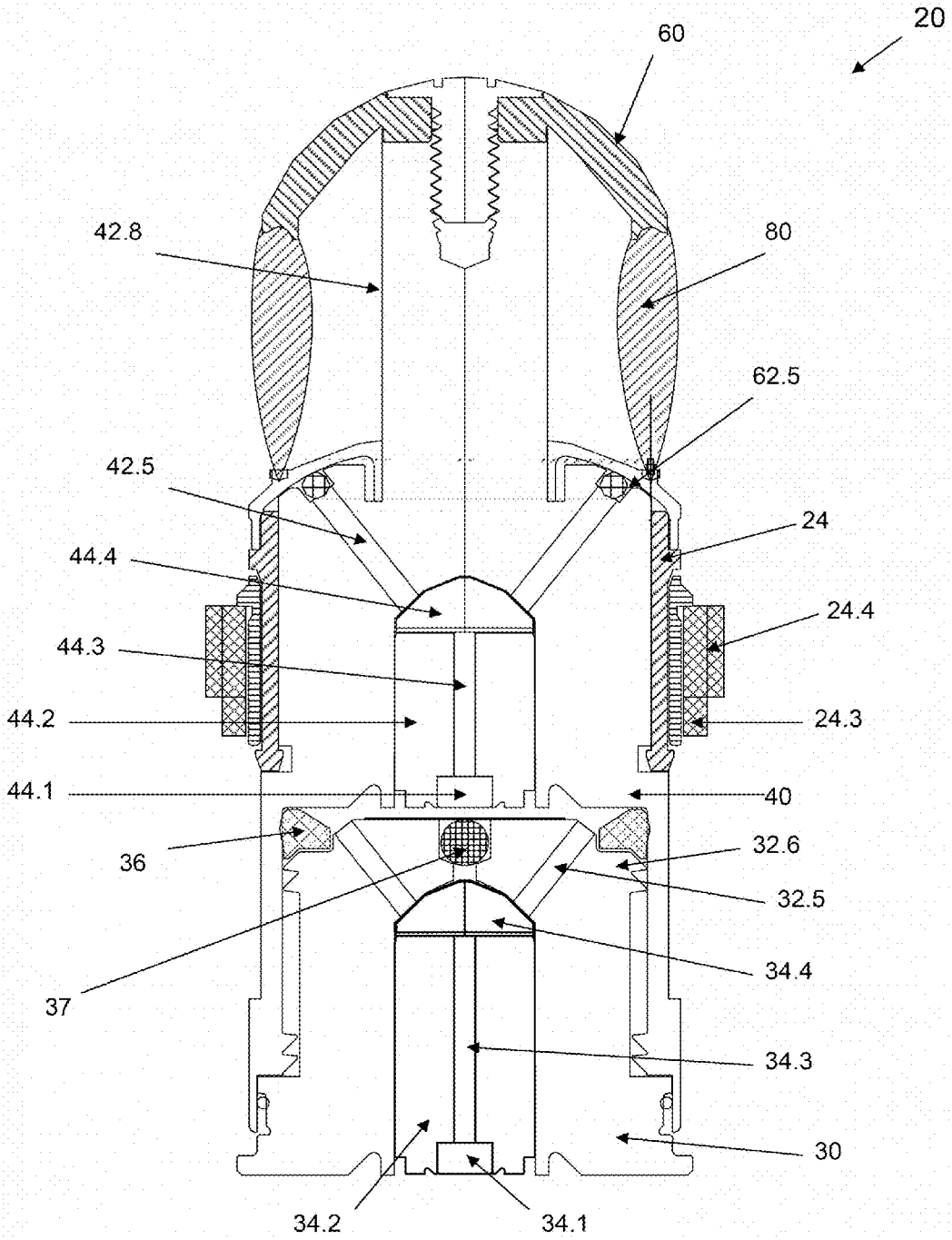
FIG. 1*a* is a cross sectional elevated view of ammunition according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention. It is understood that any reference to "the invention" is a reference to an embodiment of a family of inventions, with no single embodiment including an apparatus, process, or composition that should be included in all embodiments, unless otherwise stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims.

The use of an N-series prefix for an element number (NXX.XX) refers to an element that is the same as the non-prefixed element (XX.XX), except as shown and described thereafter. As an example, an element 1020.1 would be the same as element 20.1, except for those different features of element 1020.1 shown and described. Further, common elements and common features of related elements are drawn in the same manner in different figures, and/or use the same symbology in different figures. As such, it is not necessary to describe the features of 1020.1 and 20.1 that are the same, since these common features are apparent to a person of ordinary skill in the related field of technology. Although various specific quantities (spatial dimensions, temperatures, pressures, times, force, resistance, current, voltage, concentrations, wavelengths, frequencies, heat transfer coefficients, dimensionless parameters, etc.) may be stated herein, such specific quantities are presented as examples only, and further, unless otherwise noted, are approximate values, and should be considered as if the word "about" prefaced each quantity. Further, with discussion pertaining to a specific composition of matter, that description is by example only, and does not limit the applicability of other species of that composition, nor does it limit the applicability of other compositions unrelated to the cited composition.

Incorporated herein by reference are U.S. patent application Ser. Nos. 12/045,647, filed Mar. 10, 2008; 12/181,190, filed Jul. 28, 2008; and 12/342,915.

Figure 1B:
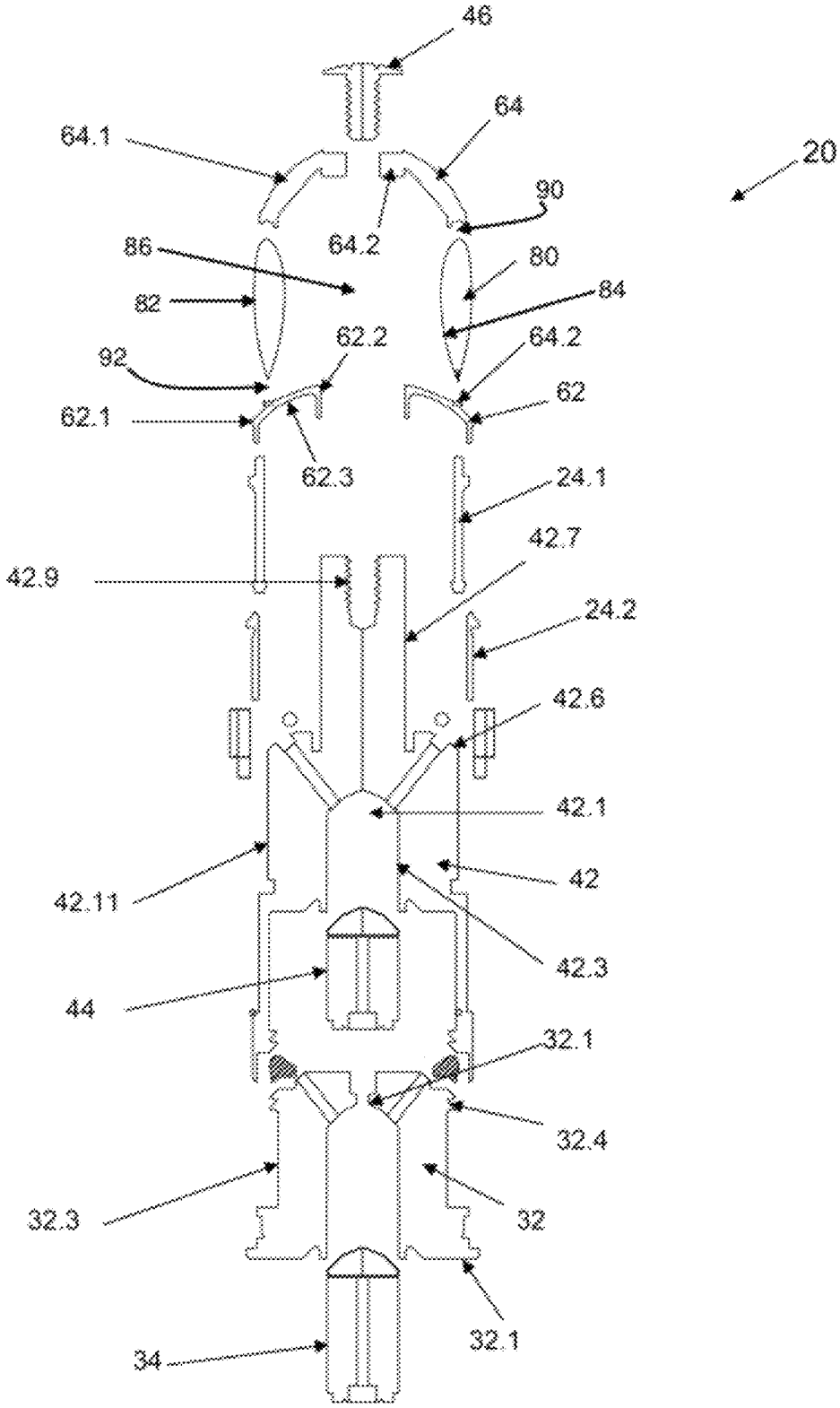
FIG. 1*b* is an exploded cross sectional view of the ammunition of FIG. 1*a*.
Figure 2:
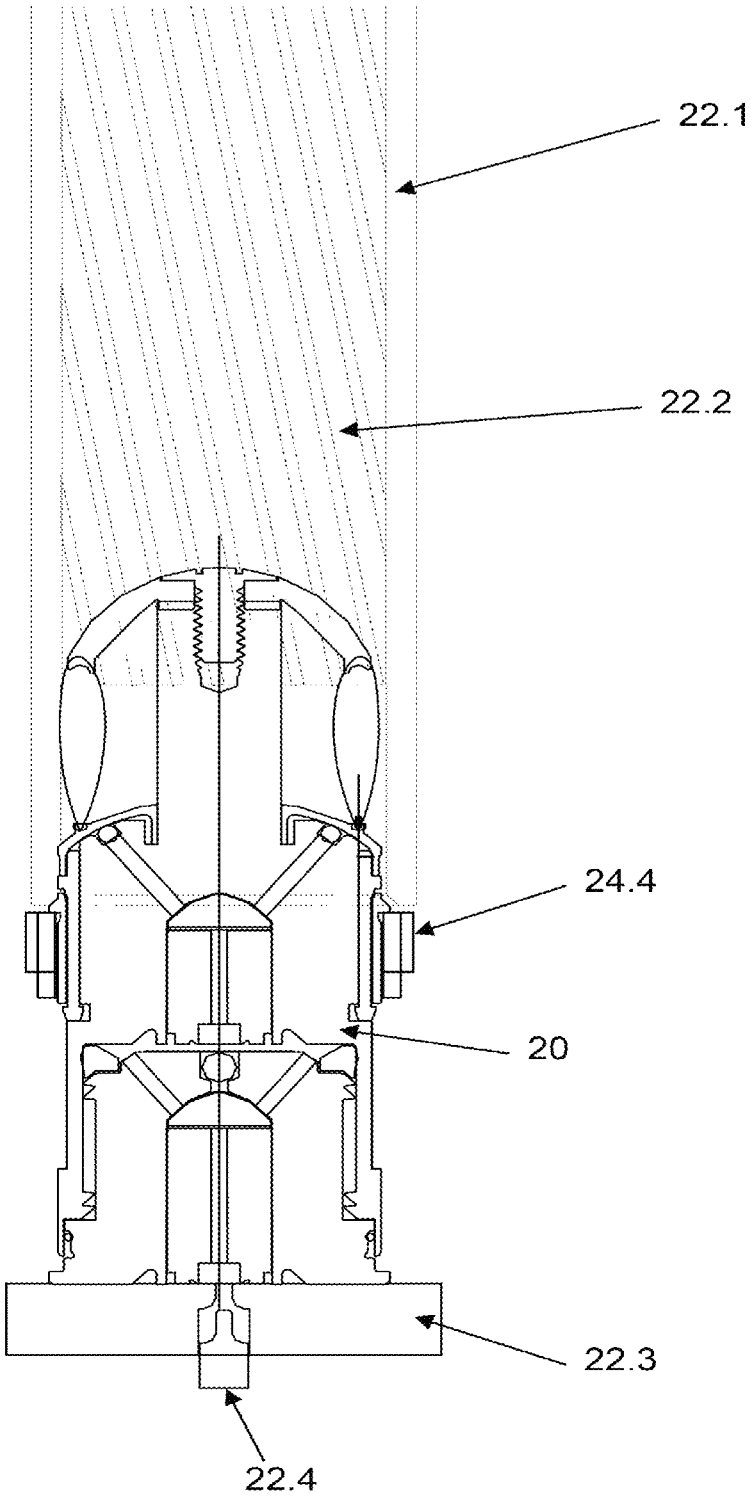
FIG. 2 illustrates a cross sectional view of the round of FIG. 1*a*, feeding into chamber of a gun.
Figure 3:
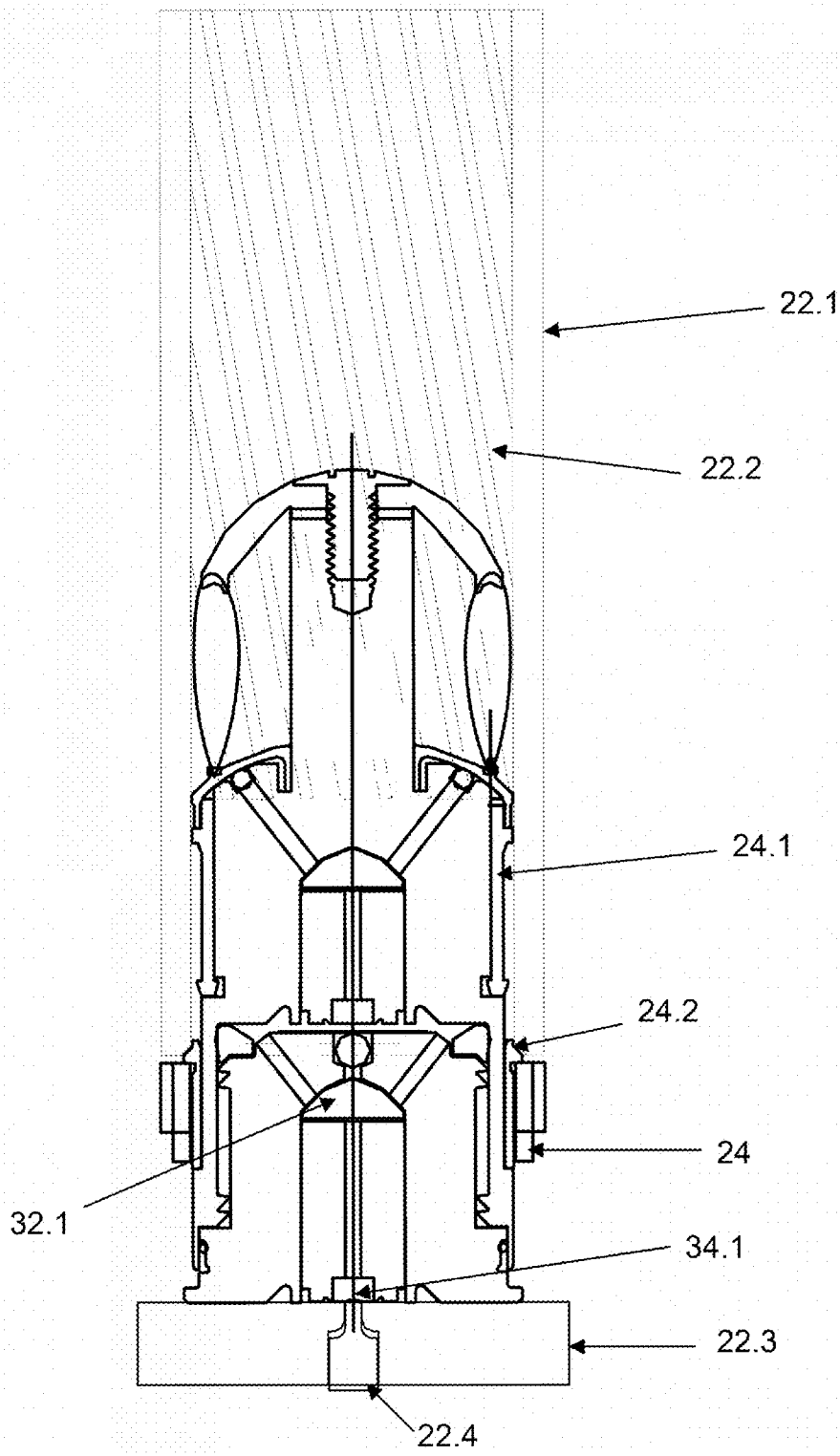
FIG. 3 illustrates a cross sectional view of the round of FIG. 1*a* chambered at the firing point in a gun barrel.
Figure 4:
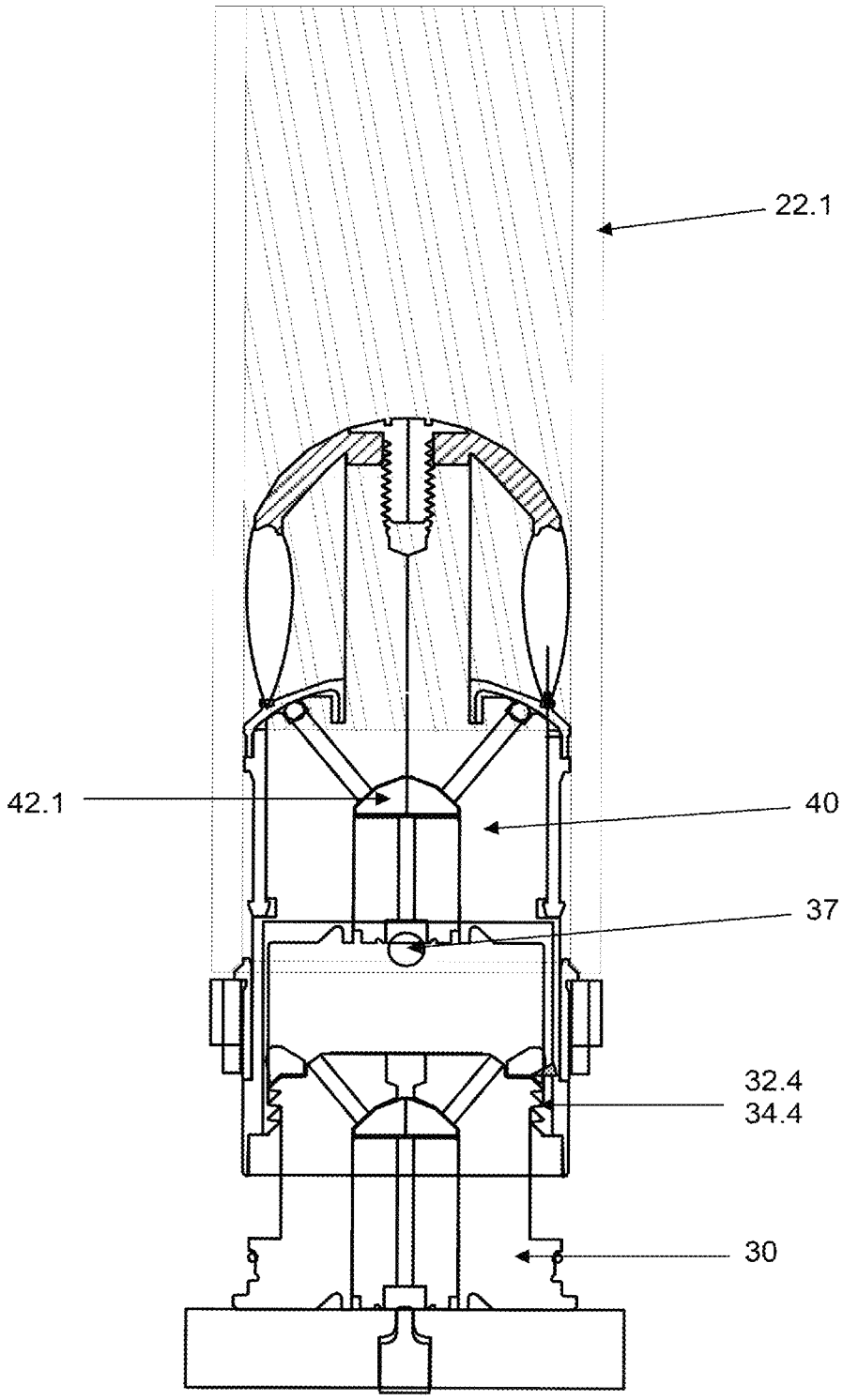
FIG. 4 illustrates a cross sectional view of the round of FIG. 1*a* as the round telescopes and fires the projectile.
Figure 5:
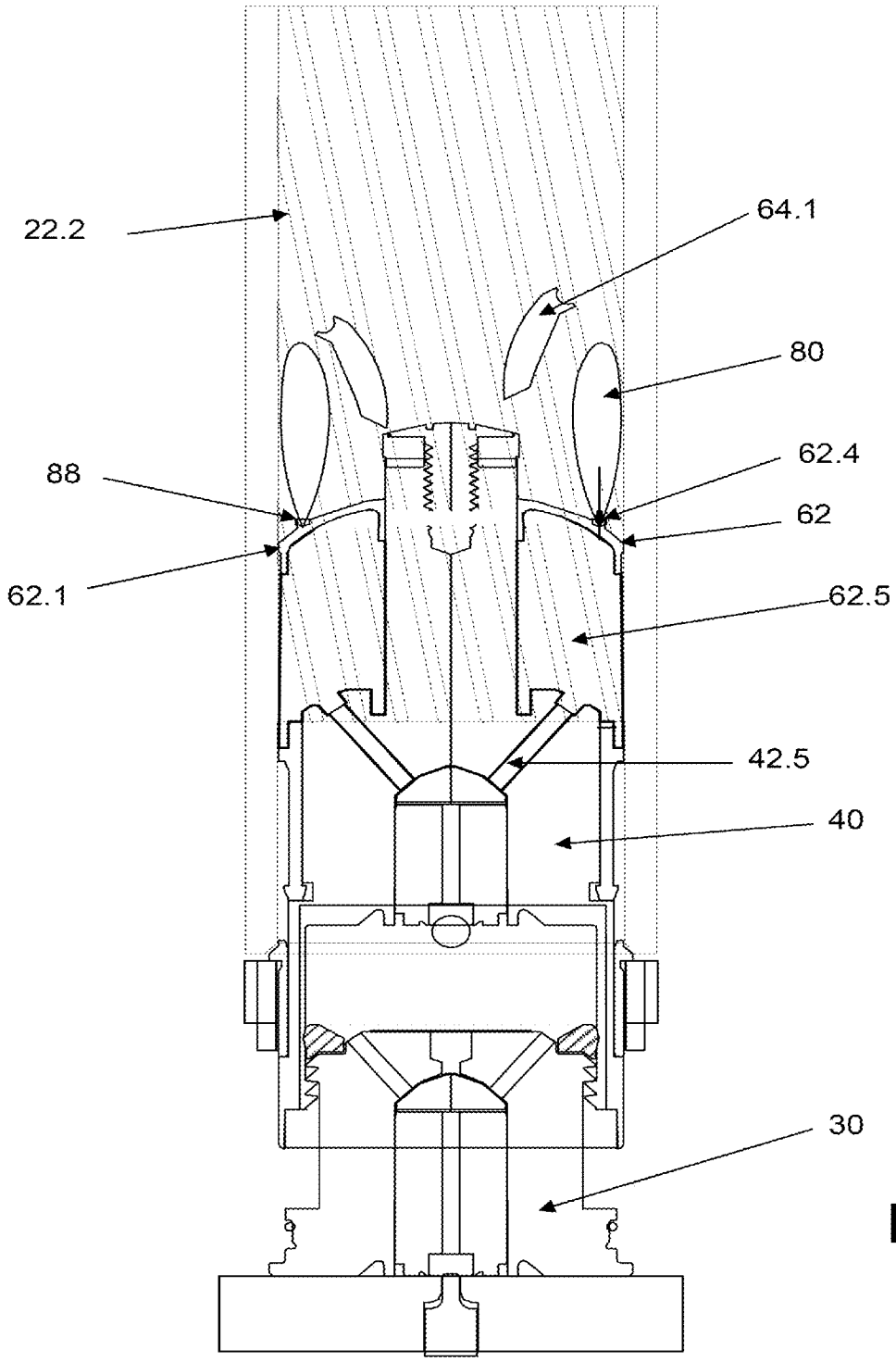
FIG. 5 illustrates a cross sectional view of the round of FIG. 1*a* as the projectile is launched in the barrel chamber.
Figure 6:
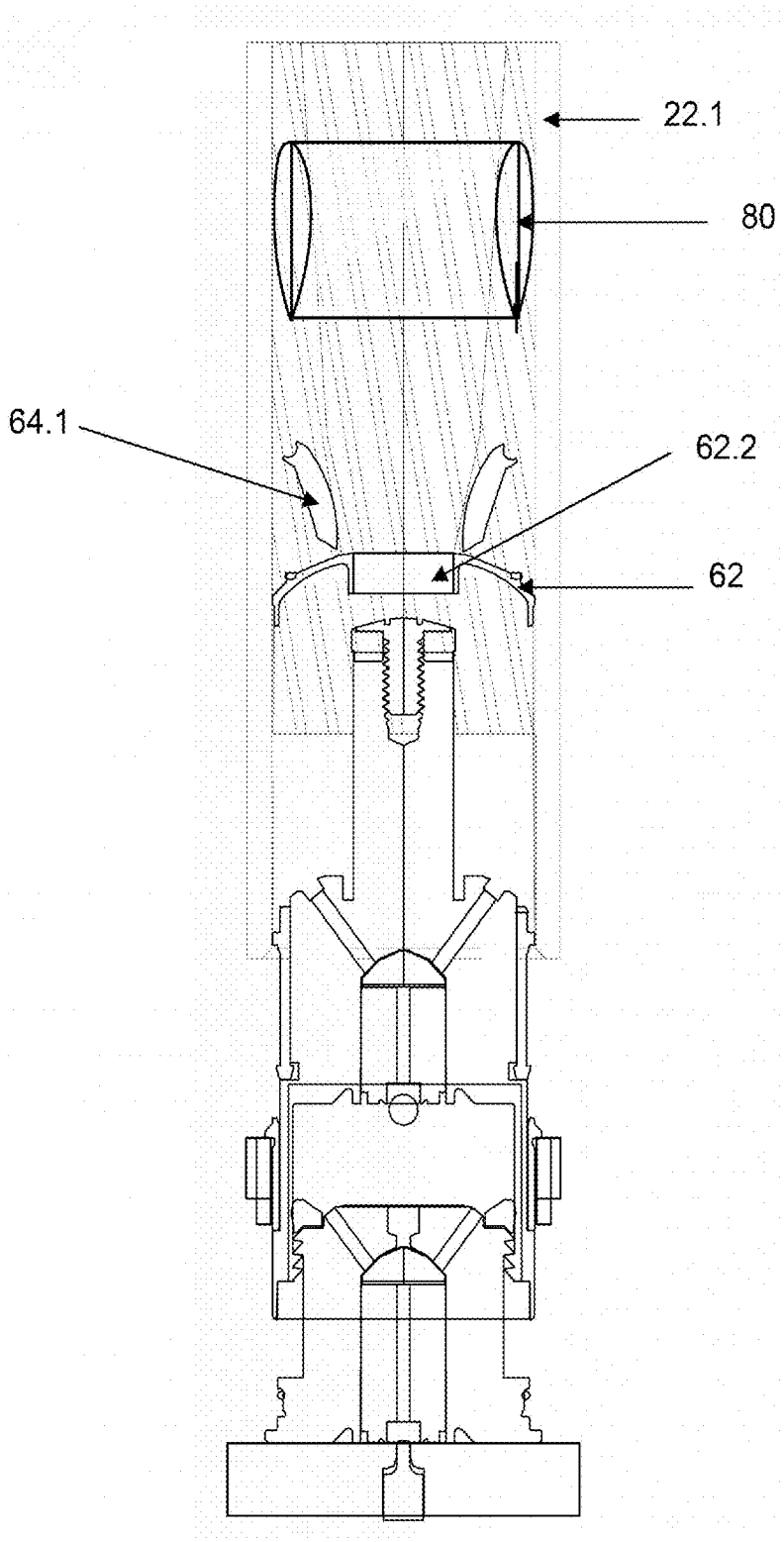
FIG. 6 illustrates a cross sectional view of the round of FIG. 1*a* as the projectile is released to travel down the gun bore and the round begins to eject.
Figure 7:
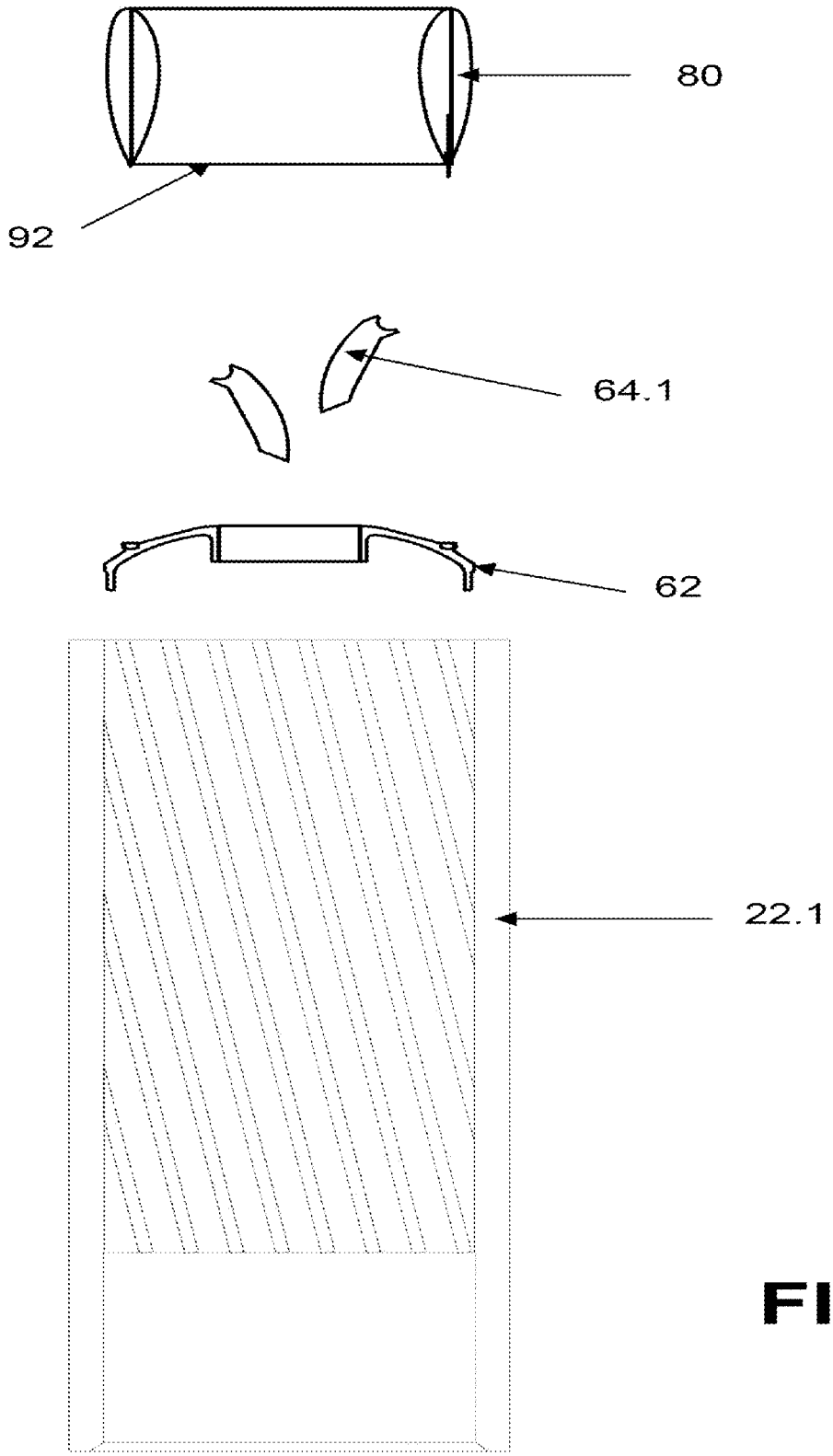
FIG. 7 illustrates a cross sectional view of the assembled ammunition round as the projectile, and F.O.D. and sabot exits the muzzle.

FIGS. 1*a* and 1*b* show cross-sectional and exploded views of a munition 20 according one embodiment of the present invention. Ammunition 20 includes a payload section 60 supported by a launch support assembly 40. Further, a telescoping assembly 30 co-acts with launch assembly 40 to provide a breech block resetting capability for automatic weapons. Ammunition 20 can be fired from any type of gun, including the Mk 19 machine gun, the Mk M203 and Milkor single shot weapons, as well as 37 mm guns.

Telescoping assembly 30 includes a support member 32 that is slidingly received within a pocket of launch support member 42. Telescoping support further includes a pocket 32.3 that receives within it an explosive assembly 34. In one embodiment, explosive assembly 34 includes an initiator 34.1 in fluid communication via a passageway 34.3 within packing 34.2 to an explosive charge 34.4. A resilient seal 36 provides sealing of the exploded charge 34.4 between members 32 and 34 prior to the rearward telescoping of member 32 relative to member 34. Circumferential abutment 32.4 interacts with abutment 42.4 to limit the sliding of member 32 relative to member 42. In some embodiments, telescoping assembly 30 further includes a ball-shaped firing pin 37 that is launched into and thereby causes ignition of initiator 44.1 during firing of ammunition 20. Telescoping assembly 30 is preferably present in those versions of ammunition 20 that are fired from automatic weapons. Some embodiments of the present invention pertain to single shot weapons that do not need the function provided by telescoping assembly 30.

Launch support assembly 40 provides secure mechanical coupling to the firing chamber of a gun, supports payload section 60, slidingly couples to assembly 30 as previously described, and further supports a linkage assembly 24. Linkage assembly 24, as shown in FIGS. 1*a* and 1*b*, is a sliding link assembly that couples adjacent ammunitions 20 to each other. Linkage assembly includes a seal and retaining member 24.1 that is received on the outer diameter 42.11 of support 42. A link mount 24.2 is slidingly received over the outer diameter of retainer 24.1. A first Link 24.3 is tightly secured to the outer diameter of link mount 24.2, and further receives and retains a captured coupling link 24.4 that couples to another coupling link of an adjacent ammunition 20.

Support member 42 of launch support assembly 40 further includes within it a pocket 42.3 that receives an explosive assembly 44. Explosive assembly includes an initiator 44.1 that is in fluid communication with an explosive charge 44.4 by way of a central passage 44.3 within packing material 44.2.

Explosive charge 44.4 is placed within a combustion chamber 42.1 of support 42. A plurality of gas release passages 42.5 provide fluid communication of the combusted explosive charge with a plurality of hemispherical balls at the exit of the passage.

In some embodiments, one or both of the combustion chambers 32.1 or 42.1 can include a rupture diaphragm such as a copper disc that is conformally placed between the explosive charge and the chamber defined by corresponding member 32 or 42. This disc contains the explosive gases until they reach sufficient pressure to rupture the disc wall and subsequently release the combusted gases into the corresponding gas passages 32.5 or 42.5.

Extending from one end of support 42 is a rod 42.7 that includes a receptacle for a fastener, such as threaded receptacle 42.9. Support 42 further includes a circumferentially extending shoulder 42.6 located proximate to the end of gas release passages 42.5. A pocket is formed around the base of rod 42.7 between the outer diameter 42.8 of the rod and the inside of shoulder 42.6.

A payload section 60 is received on rod 42.7 and shoulder 42.6 of support member 42. Payload section 60 includes a sabot that is fittingly received on shoulder 42.6. A frangible retainer 64 is received on the distal end of rod 42.7. A ringed airfoil projectile 80 is captured between sabot 62 and retainer 64.

Sabot 62 includes a curving annular middle section located between an inner cylindrical portion 62.2 and an outer cylindrical portion 62.1. The inner face of the annular midsection is received against shoulder 42.6. The inner diameter of cylindrical section 62.2 is in sliding contact with outer diameter 42.8 of rod 42.7. The outer diameter of outer cylindrical portion 62.1 includes an outer most diameter that is in sliding contact with the inner diameter and rifling 22.2 of the barrel 22.1 of a gun 22. Sabot 62 further includes a plurality of circumferentially extending drive features 62.4 that couple to corresponding and complementary driven features of ring airfoil 80.

Retainer 64 includes a center support ring 64.2 that is held on the end of rod 42.7 by a fastener or other coupling means 46. A plurality of outwardly extending and separated petals 64.1 extend from support ring 64.2 a frangible feature such as a notch is preferably located at the connection of a petal to the support ring, and acts as a stress riser during operation. Each petal extends outwardly and aft (aft being defined as the direction toward telescoping assembly 30 and forward being defined as the direction toward payload section 60 and further toward the open end of the gun barrel), and on the aft face of each petal there is a small pocket for receiving within it the leading edge 90 of ring air foil 80. Ring air foil 80 is captured on ammunition 20 between sabot 62 and retainer 64.

The following is a description of the firing of ammunition as shown in FIGS. 2-7.

Upon being on the bolt face in the ready battery position, latched and ready to be fired, the trigger is pulled. The bolt travels forward until the firing pin 22.4 is released, about 1" from the breech face 22.3.

The pin strikes the aft telescoping charges primer initiating the propellant; simultaneously an initiation ball 37 is propelled forward to a primer 34.1 for the forward payload propelling charge, and the expanding gas reacts against the telescoping piston to open the action and autoload function the gun.

The forward payload propelling charge expands against the sabot/pusher 62 pushing it forward while fracturing the projectile retainer 64 along one or more separation groove(s) on the central hub of the retainer releasing the sabot and projectile assembly for forward travel.

The sealing and rotating outer diameter 62.1 of sabot 62 seals the propelling gas from the action at the forcing cone of the chamber. The sabot/projectile assembly 160 is pushed along the bore and along the center guide mandrill 42.7, throughout the launch sequence. The sabot/projectile assembly travels down the bore to the end of the guide mandrill having spin imparted to the assembly by the action of rifling 22.2 in the gun bore 22.1 rotating the sabot 62 which transfers the rotation by the action of drive dogs 62.4 on its forward face engaging slots 88 in the tail 92 of the ring airfoil projectile 80.

As the sabot leaves the mandrill the propelling gas are vented down the center of the sabot down the bore ahead of the sabot/projectile assembly, protecting the ring airfoil projectile from disturbance by the gas, at which point the maximum velocity is achieved for both the sabot and projectile.

The sabot immediately begins to decelerate due to friction with the bore. This causes the projectile to separate, which in some embodiments has little or no contact with the bore and little friction retarding its passage down the bore.

The projectile rides a turbulent boundary layer of air between its outer diameter and the bore guiding and centering it until it exits the muzzle. The sabot exits the muzzle at greatly reduced energy. The ring airfoil 80 is free to fly towards the target.

Although what has been shown and described is the launching of a ring airfoil projectile by an explosive charge, it is understood that other embodiments of the present invention contemplate the launching of different kinds of projectiles, and the launching of projectiles other than by use of explosive charges. As one example, some embodiments of the present invention include the placement of a plurality of spherical balls within the munition that are propelled forward by a sabot. As another example, yet other embodiments contemplate the launching of a projectile that is substantially bullet shaped, yet with features that are pushed upon by the sabot to impart a launching velocity to the projectile.

Figure 8:
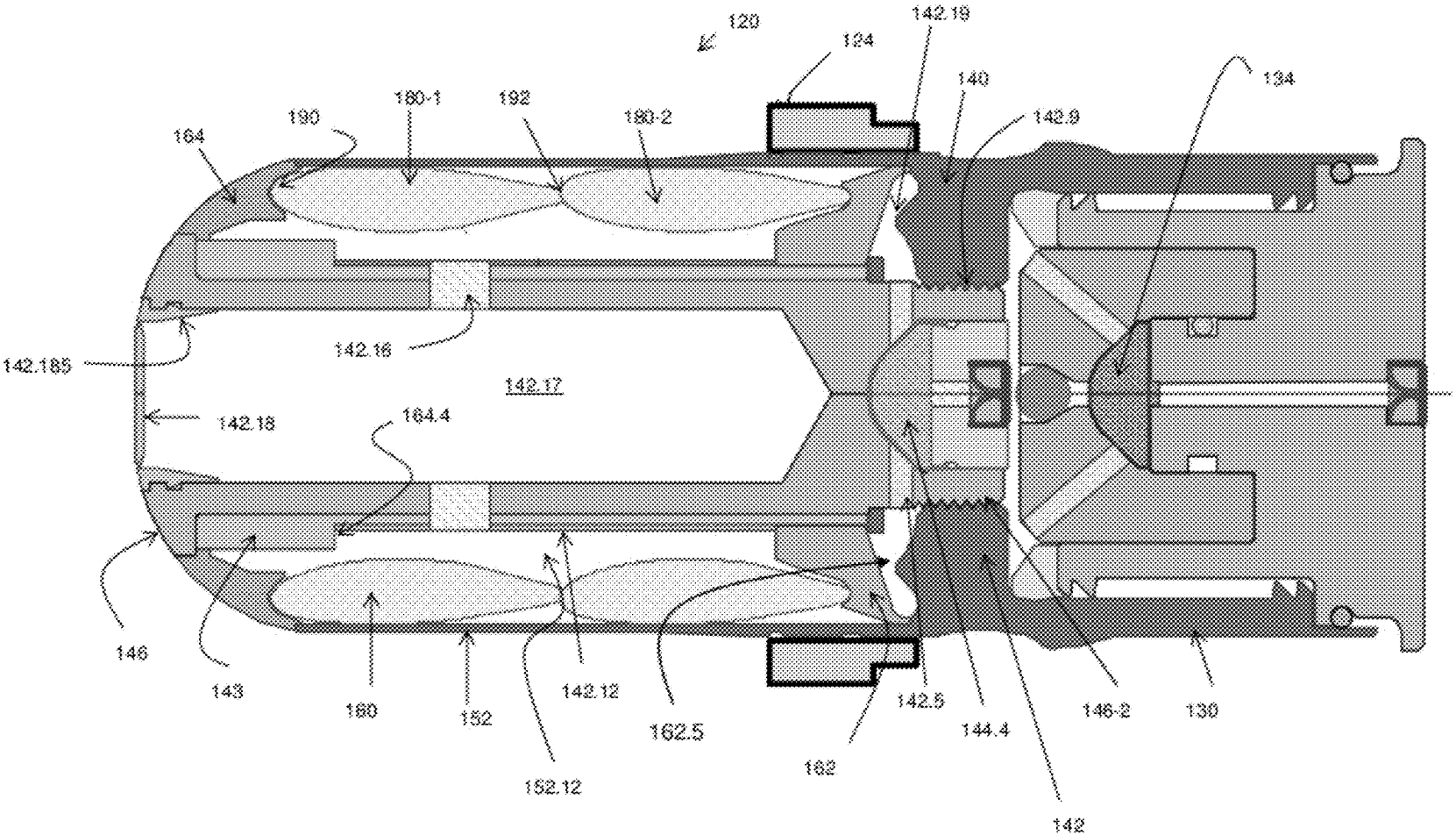
FIG. 8 is a side elevational cross-sectional representation of a multifire munition according to one embodiment of the present invention.

Yet other embodiments contemplate the use of compressed gas to provide a pressure force on the sabot. The latter embodiment can be used in those situations in which the handling of explosives is not desired. In some of these embodiments, the gas may take the form of compressed air, compressed carbon dioxide, or the like. In yet other embodiments, the compressed gas is created by electronically triggering a gas-forming component such as an azide salt (such as sodium azide). Yet another example is the use of a gas-forming compound such as nitroguanaidine FIG. 8 is a cross-sectional representation of a munition 120 similar to munition 20, except for differences which will now be described. FIG. 8 has been substantially drawn to scale. However, this scaling does not impose any limitations on the various embodiments of inventions disclosed herein, unless stated otherwise.

Munition 120 includes front and rear projectiles 180-1 and 180-2, respectively, in the payload section 160. Both projectiles as well as the sabot 162 are contained within a generally cylindrical housing 152 that is a forward extension of support 142. Housing 152 not only protects the projectiles during handling, but also provides repeatable launching conditions, as compared to unprotected projectiles being fired in gun barrels fabricated by different manufacturers with different tolerances. Projectiles 180-1 and 180-2 are spun during launch by spiral rifling on the central rod and the sabot inner surface 162.3, and the inner surface of housing 152 is preferably smooth. However, other embodiments of the present invention contemplate a rifled inner surface 152.12 of the housing that acts to spin the projectiles, by interaction between the housing inner surface and the sabot outer surface 162.1.

Preferably, munitions in various embodiments of the present invention include projectiles that are spun by a single interaction, and not by multiple interactions. Examples of these interactions include: between the sabot outer diameter and a rifled inner bore of the gun barrel or the housing; between the inner diameter of the sabot and the rifled outer diameter of a central rod; or, between the outer surface of one or both projectiles and the inner diameter of the barrel; or, between the outer diameter of one or both of the projectiles and the inner diameter of the cylindrical housing.

The leading edge 190 of front projectile 180-1 nests within the complementary-shaped pocket of retainer 164. The trailing edge 192 of projectile 180-1 includes an aft face that is partly concave so as to provide an annular area in contact with and nested on the leading edge of the aft projectile 180-2. The trailing edge 192 of aft projectile 180-2 is received within a complementary-shaped pocket of sabot 162.

Yet other embodiments of the present invention contemplate a trailing edge of a forward projectile that includes a plurality of features that interlock with complementary-shaped features on the leading edge of the aft projectile. As one example, the trailing edge of the forward projectile could include a plurality of protruding male features that interlock with or received within a similarly spaced plurality of pockets or female features on the leading edge of the aft projectile. Conversely, the trailing edge of the leading projectile could include a plurality of recessed female features that interlock with complementary-shaped male features on the leading edge of the aft projectile. As one example, the trailing edge of the leading projectile can include a plurality of cylindrical pins that extend aft from the trailing edge, and which interlock with a plurality of cylindrical receptacles on the leading edge of the aft projectile. In one embodiment, four, equally-spaced ends and receptacles are contemplated extending about 0.05 inches from the aft of the trailing edge In yet other embodiments, only the aft projectile is spun by interaction with the rifled surface. The forward projectile is spun by the aft projectile's contact with the rifled surface. As one example, the aft projectile is spun during firing by the interaction of the sabot with either the rifled outer diameter of the rod or the rifled inner diameter of either the barrel or the housing. In those embodiments in which the spinning is created by interaction between the outer diameter of the aft projectile and the inner diameter of the housing, the outer diameter of the forward projectile may be fabricated to a dimension that is small enough so that there is a gap between the forward projectile and the inner diameter of the housing.

Launch support assembly 140 includes a fastener 146 that incorporates a central cylindrical rod portion 142.7. Fastener 146 includes a threaded interface 146.2 that is received within threads of the support 142. The threaded end of fastener 146 further includes a pocket 142.3 that contains within it an explosive assembly 144. Further, a plurality of radially-outwardly extending vents 142.5 provide fluid communication after ignition from combustion chamber 142.1 to the underside of sabot 162. It can also be seen that gasses expelling radially outwardly from the combustion chamber will be directed toward the underside of sabot 162 by a ridge 142.19 that is the forward most portion of a concave-shaped recess within support 142 (as viewed from left to right in FIG. 8).

Fastener 146 is preferably surrounded by a cover 143 that extends generally along the length of fastener 146. In one embodiment, cover 143 is a layer of an organic material that is molded over the metallic fastener. However, in yet other embodiments cover 143 is a separately fabricated component that is slid over and fastened to the outer diameter of fastener 146. Preferably, the outer surface of cover 143 includes rifling 142.12 in a spiral pattern. Rifling 142 engages with complimentary rifling on the inner diameter of sabot 162, such that the translation of sabot 162 along cover 143 results in an induced rotation.

In some embodiments, fastener 146 includes one or more vent passages 142.16 that permit fluid communication from the chamber holding the projectiles 180 into an interior plenum 142.17. Passageways 142.16 extend through the sidewalls of fastener 146 and through the overmolded cover 143. Cover 143 further includes a sabot stop 164.4 that prevents motion of sabot 162 after the projectiles have been pushed along the length of the rifled surface 142.12.

At the end of launching, the front face of sabot 162 is received against sabot stop 164.4. The inner diameter of sabot 162 has an axial extent that is not sufficient to fully close off apertures 142.16. Therefore, the pressure from the explosive charge that is acting between the forward face of support 142 and the aft face of sabot 162 is able to leak out of the projectile chamber and flow into plenum 142.17. Therefore, the explosive pressure is suddenly reduced as it leaks into plenum 142.17. Further, the pressure is sufficient in some embodiments to blow off a cap 142.18 that is received within the forwardmost end of fastener 146. This cap is attached by frangible sections to a stepped ring that couples to complementary grooves of fastener 146. Cap 142.18 prevents ingestion of dirt into plenum 142.17. However, when cap 142.18 is blown off at the end of the launch sequence, the gas from the explosive charge is directed in a forward manner down the barrel and generally along the centerline of the barrel. In some embodiments, the coupling ring that attaches the cap to fastener 146 has a slightly concave shape 142.185 (i.e., a converging nozzle) to better direct the flow of the remaining explosive charge. Preferably, the outer diameter of both projectiles is smaller than the inner diameter of the barrel, so as to create an annular gap. Boundary layer effects between the projectile OD and the barrel ID help center the projectile within the barrel and minimize the contact between the projectile in the barrel.

Figure 9:
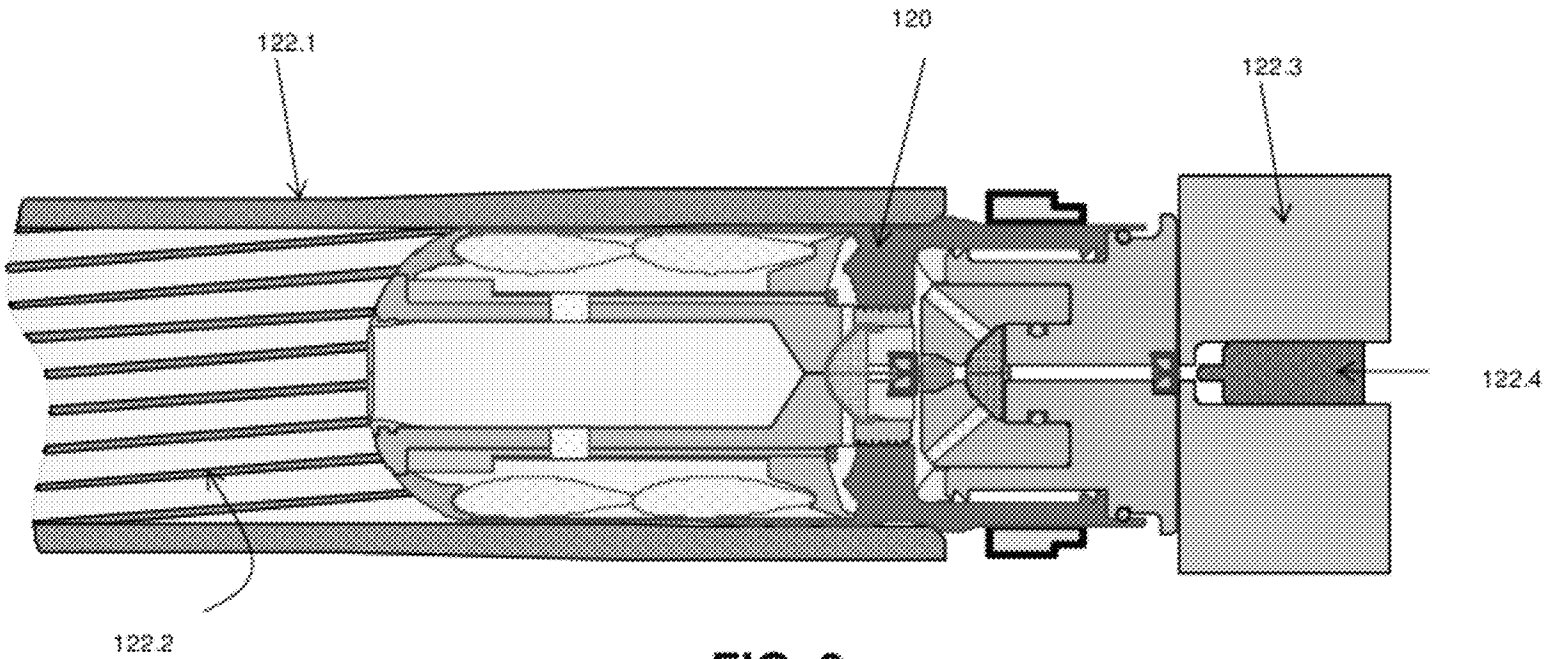
FIG. 9 is a cross-sectional view of the munition of FIG. 8 chambered in the breech of a gun.

FIGS. 9-14 show various phases of the firing of the munition 120 according to one embodiment of the present invention. FIG. 9 is a schematic representation of a munition 120 as loaded in an apparatus such as an Mk 19 machine gun. The breech block 122.3 pushes munition 120 forward, such that a shoulder of support 142 comes into contact with the edge of barrel 122.1. A firing pin 122.4 is shown ready to fire.

Figure 10:
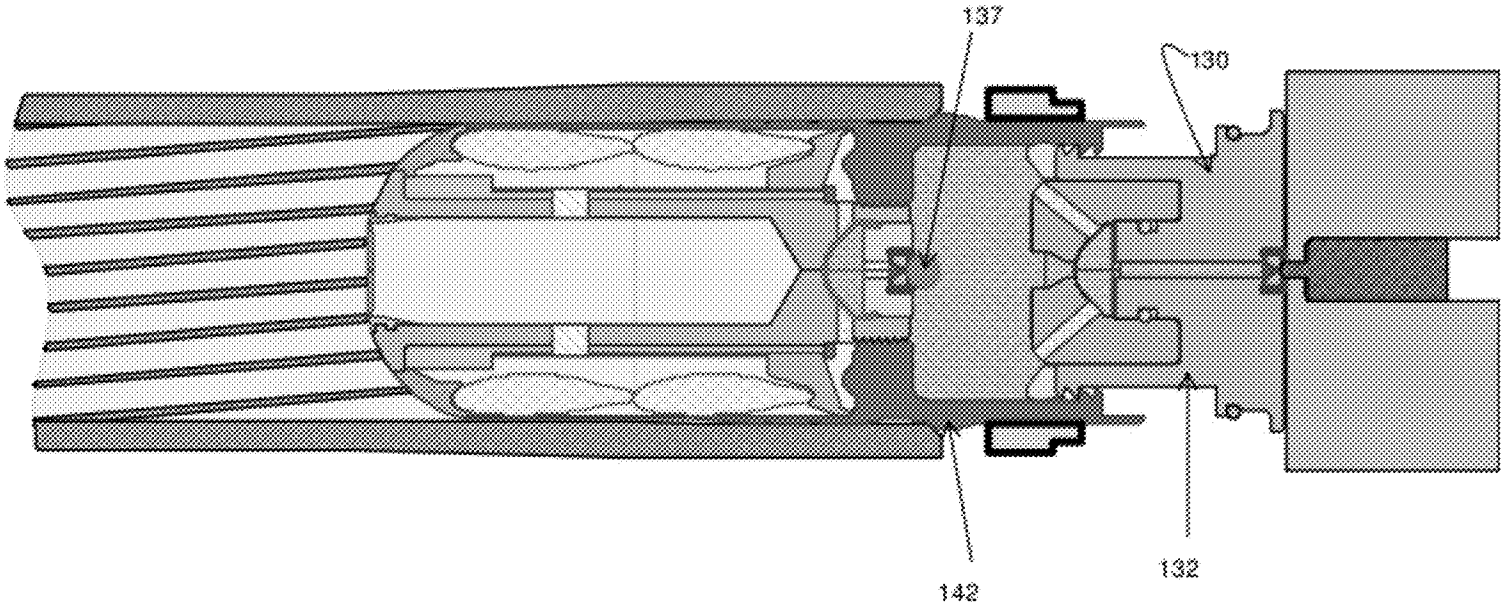
FIG. 10 is a cross-sectional representation of the apparatus of FIG. 9 after the first charge has fired and the telescoping section has extended rearward.

FIG. 10 shows the backward movement of telescoping assembly 130 after the firing pin has ignited the primer and the first charge. High pressure gas acting between the telescoping support 132 and the support 142 pushes backward on support 132, which in turn pushes breech block 122.3 backward to begin cycling of the machine gun. A ball 137 has also been fired forward into a second primer within launch support assembly 140.

Figure 11:
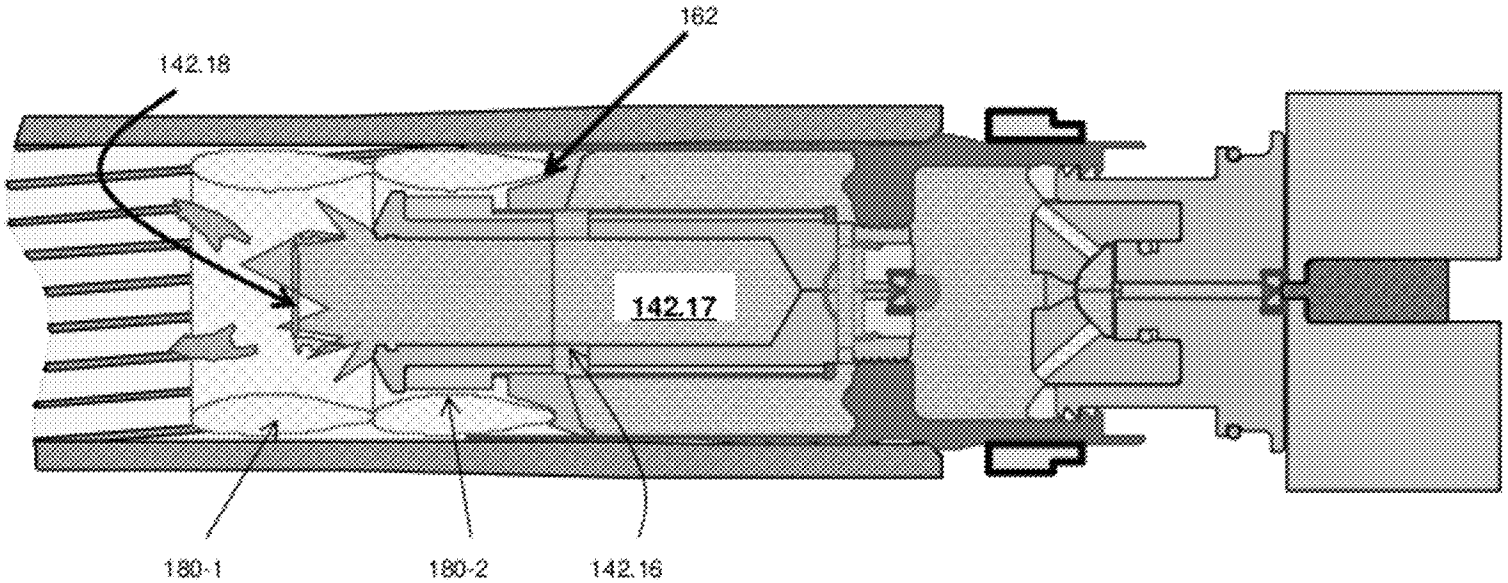
FIG. 11 is a cross-sectional representation of the apparatus of FIG. 10 after the second charge has fixed and the payload is being launched down the barrel.

FIG. 11 shows the state of the munition after the second explosive charge has become ignited by the action of ball 137 on initiator 144.1. Combustion gases act against the aft face of sabot 162, and sabot 162 in turn pushes projectiles 180-1 and 180-2 forward down the barrel. The leading edge of forward projectile 180-1 has broken off petals 164.1 from retainer 164, thus permitting both projectiles to begin flight. I It can be seen that the aft face of sabot 162 has moved over aperture 142.16, thus allowing combustion gas from the second explosive charge to enter plenum 142.17, which becomes pressurized and blows off cap 142.18. In yet other embodiments, the cap is not blown off, but continues to be retained by fastener 146. In those embodiments in which the cap is retained, it is noted that there is still a sudden reduction of pressure as the combustion gas fills plenum 142.17, even though the plenum remains pressurized. In yet other embodiments, the cap includes an aperture such that even though the cap is retained in place, the pressure within plenum 142.17 reduces to ambient pressure after sufficient time has elapsed.

Figure 12:
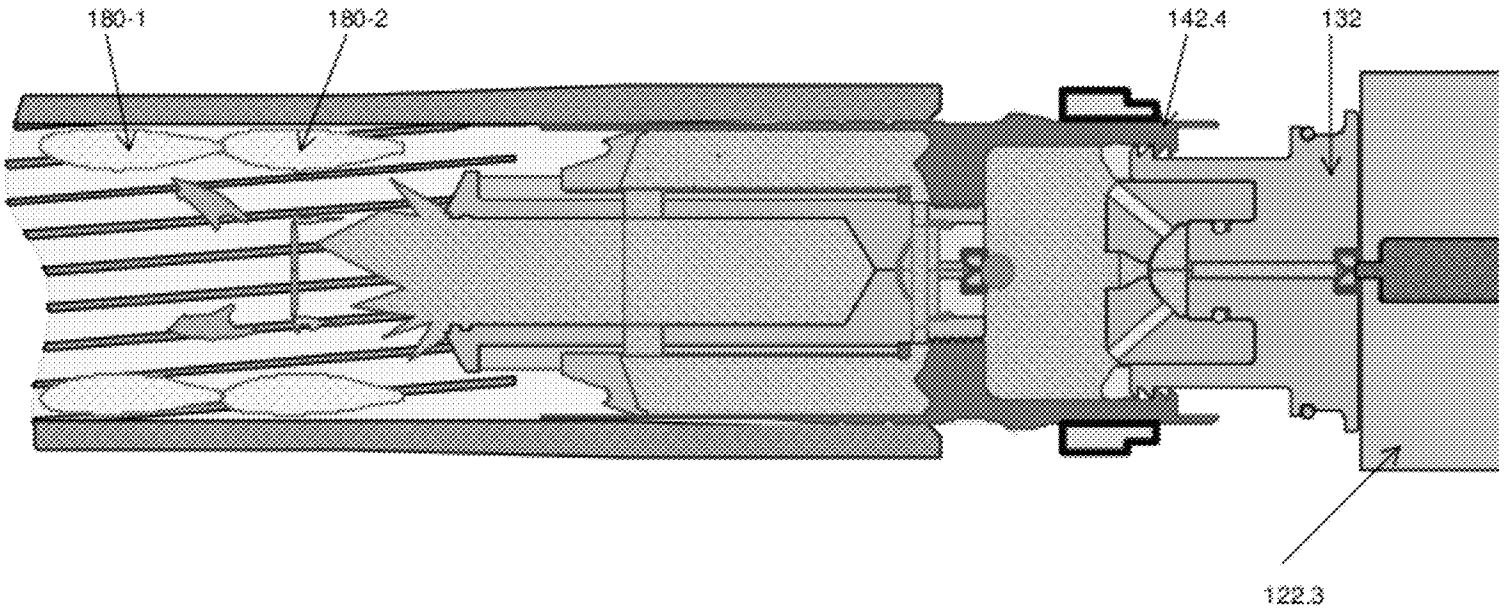
FIG. 12 is a cross-sectional representation of the apparatus of FIG. 11 with the sabot stopped and with ejection of the spent round starting.

FIG. 12 shows the start of the ejection of the spent munition from the breech of the machine gun. The aft momentum of support 132 continues to move breech block 122.3 in an aft direction, and further the front edge of support 132 acts on support 142 to likewise pull it in a rearward direction. The twin projectiles continue their flight down the barrel.

Figure 13:
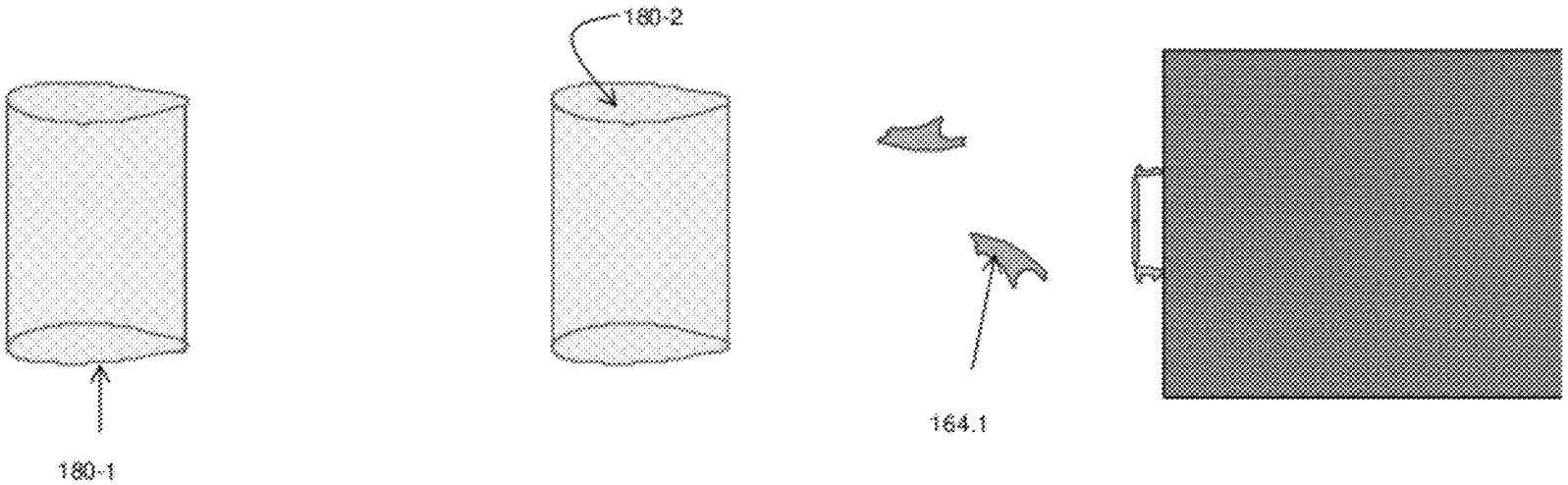
FIG. 13 is a cross-sectional representation of two projectiles and debris exiting the barrel of the gun.
Figure 14:
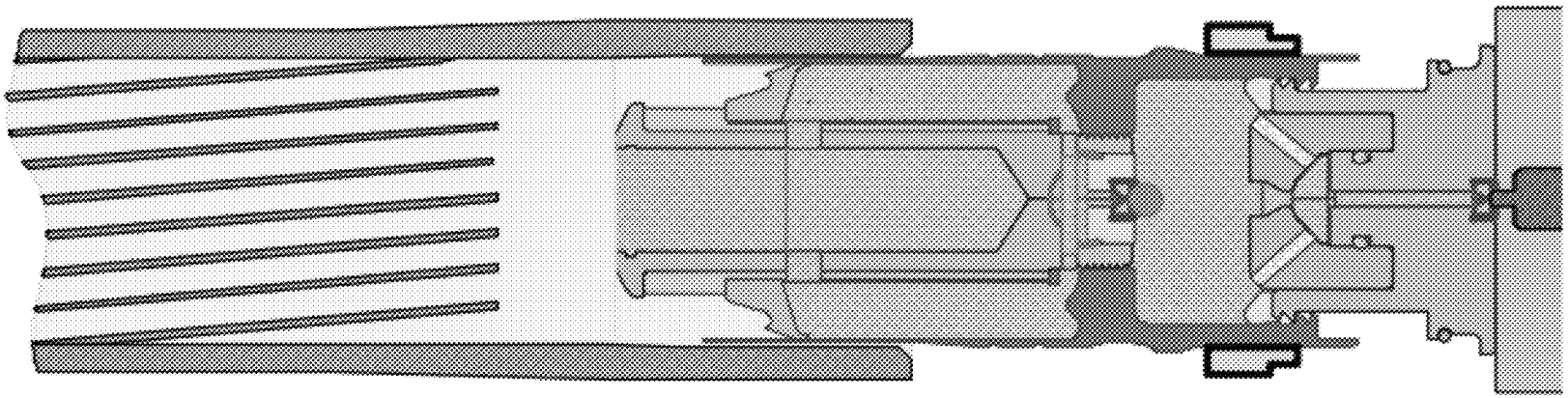
FIG. 14 is a cross-sectional representation of the spent munition being ejected from the gun.

FIG. 13 shows the two projectiles exiting from the muzzle of gun 122, along with debris such as the petals and the cap. FIG. 14 shows the spent munition (the telescoping section 130 and the launch support assembly 140) about to exit from the breech of the machine gun.

Figure 15:
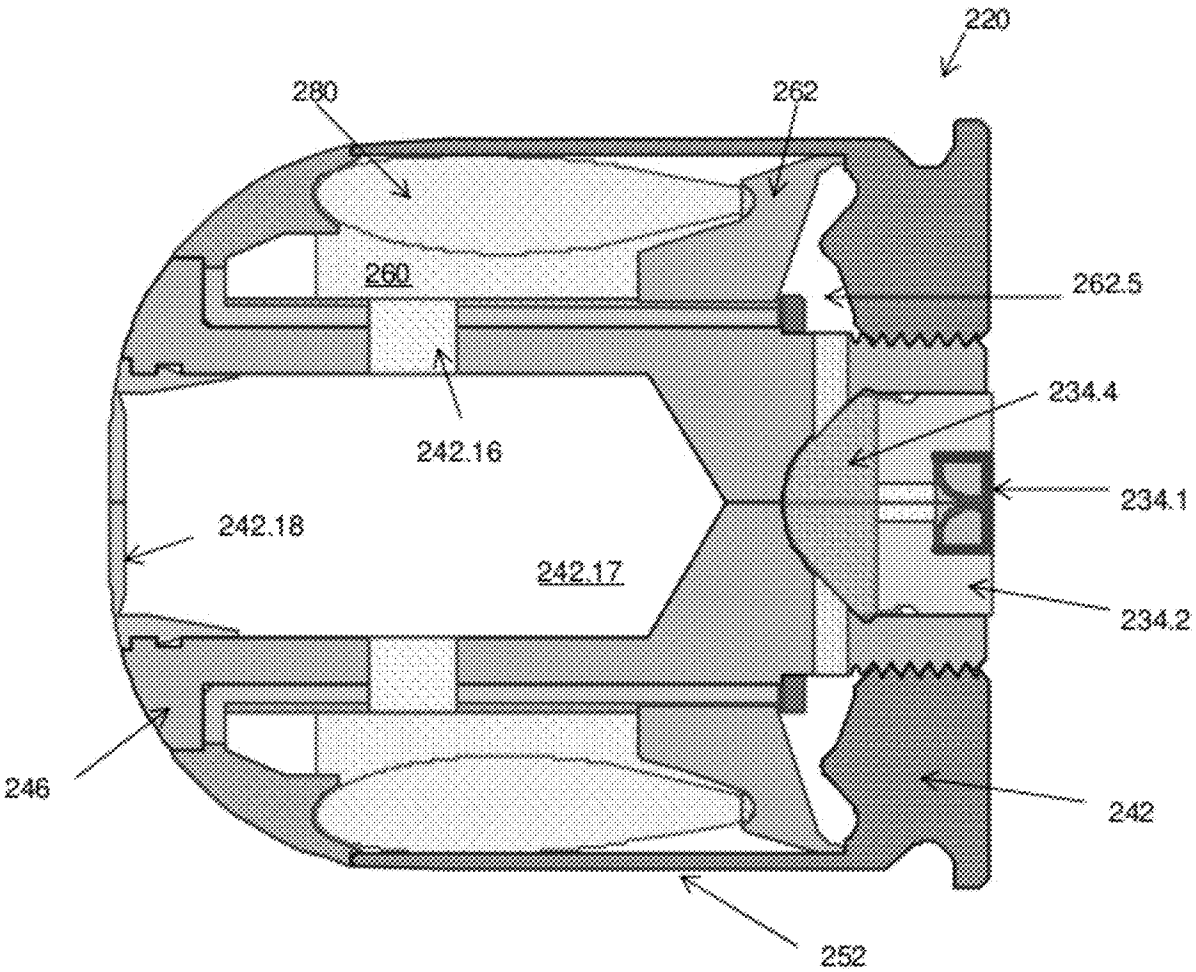
FIG. 15 is a side elevational cross-sectional representation of a single shot less lethal munition according to another embodiment of the present invention.
Figure 16:
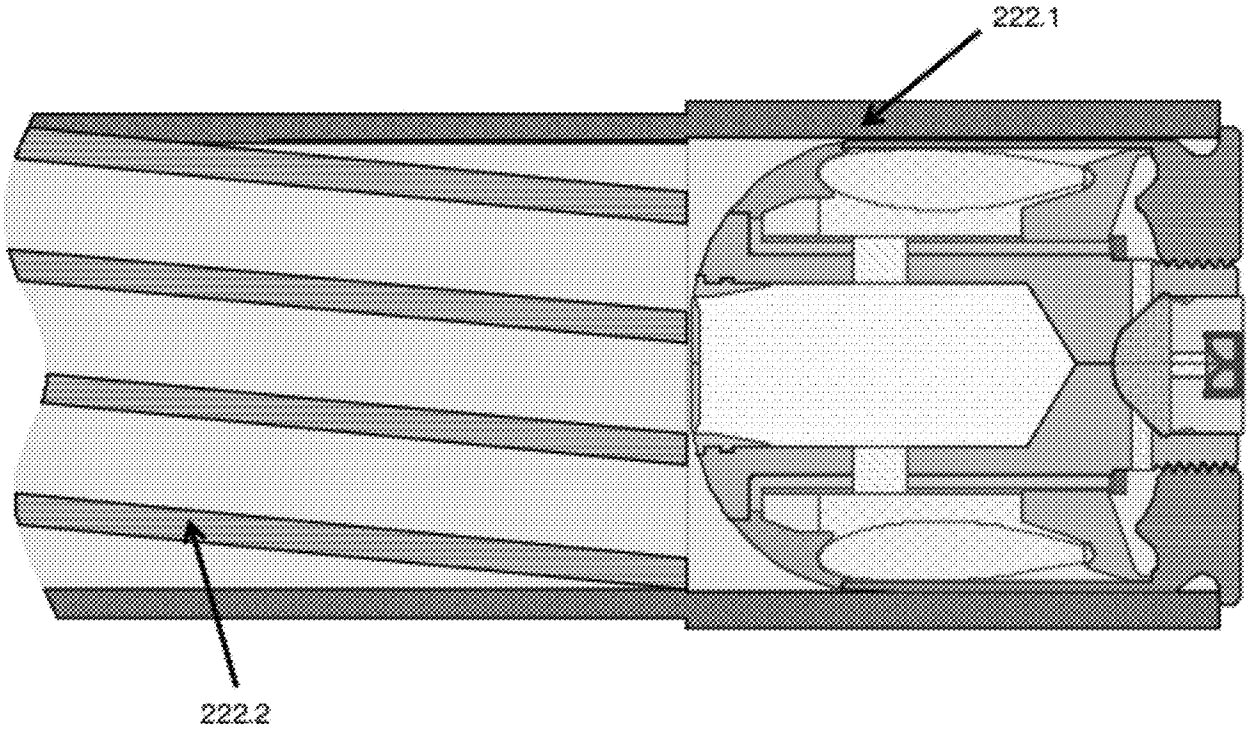
FIG. 16 is a cross-sectional representation of the munition of FIG. 15 chambered in a barrel.
Figure 17:
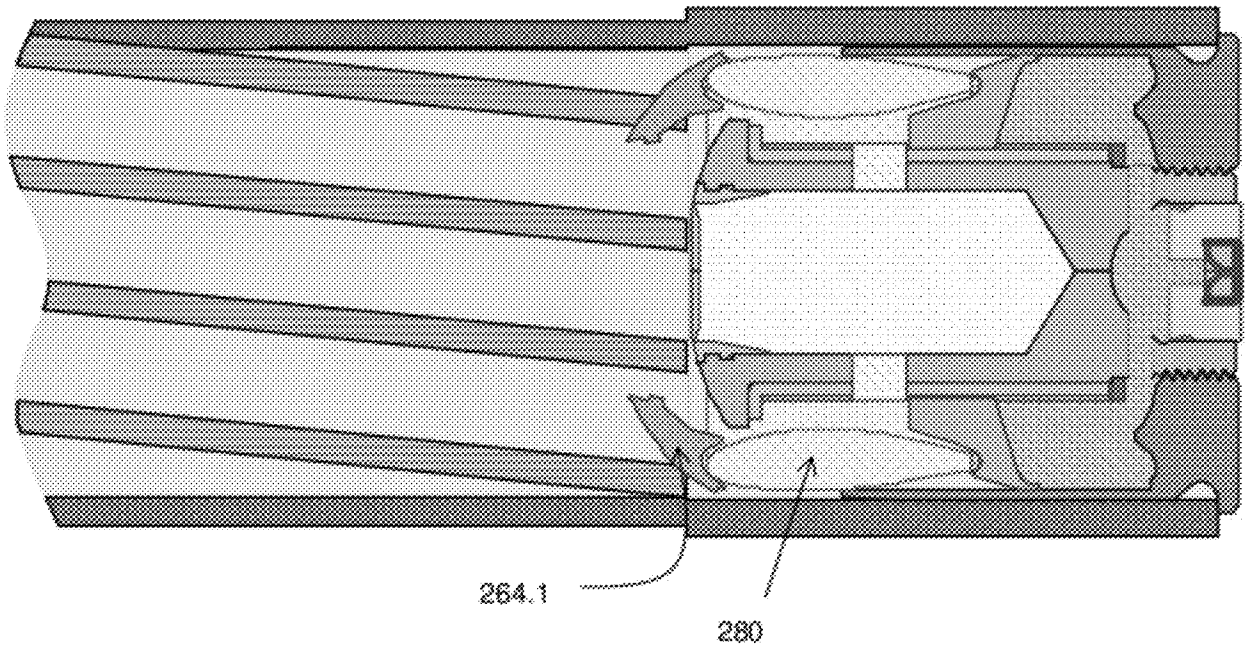
FIG. 17 is a cross-sectional representation of the apparatus of FIG. 16 with the explosive charge ignited and the sabot pushing against the projectile.
Figure 18:
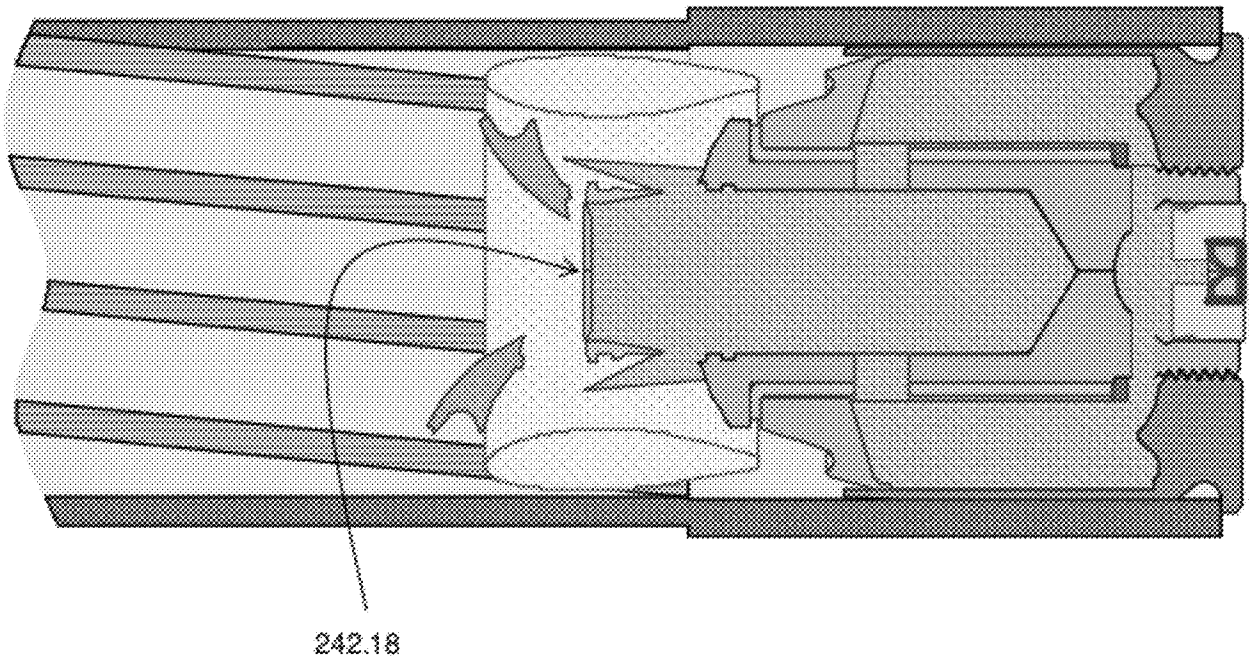
FIG. 18 is a cross-sectional view of the apparatus of FIG. 17 with the projectile exiting the munition and the front cover of the munition blowing off in a forward direction.
Figure 19:
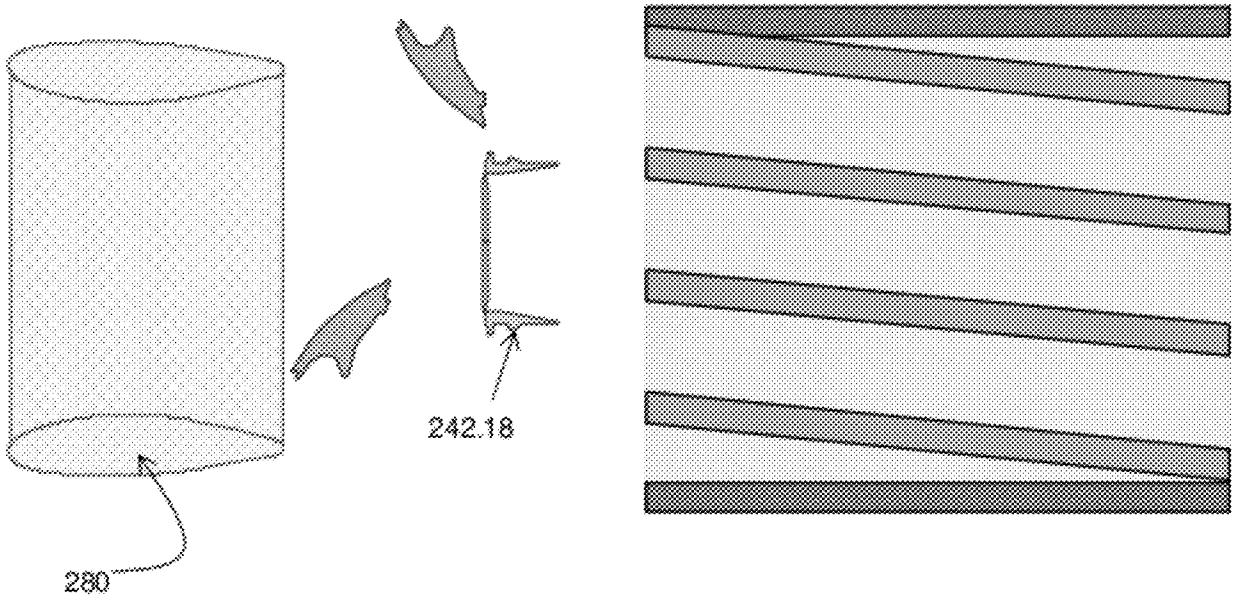

FIG. 15 is a cross sectional representation of a munition 220 with similarities to that of munition 120, except for differences that will be described. FIG. 15 has been substantially drawn to scale. However, this scaling does not impose any limitations on the various embodiments of inventions disclosed herein, unless stated otherwise. Munition 220 includes a single projectile 280 in the payload section 260. Further, support 242 is adapted and configured for a single shot, non-automatic application, such as the M203 launcher. FIGS. 16-19 depict various phases of firing of munition 220 and launching of projectile 280 from as barrel 222.1 of a single shot armament.

FIGS. 25 to 37 show photographs of two, single shot munitions 220 and 320 according to various embodiments of the present invention. It is appreciated that the munition 220 shown in these photographs is one express embodiment of the similarly numbered munition 220 shown in FIGS. 15-19. It is also to be appreciated that there may be differences between the version of munition 220 shown in FIGS. 25-37, as compared to munition 220 shown in FIGS. 15-19, as can be the case as changes are made from the drawings during the fabrication process.

Figure 26:
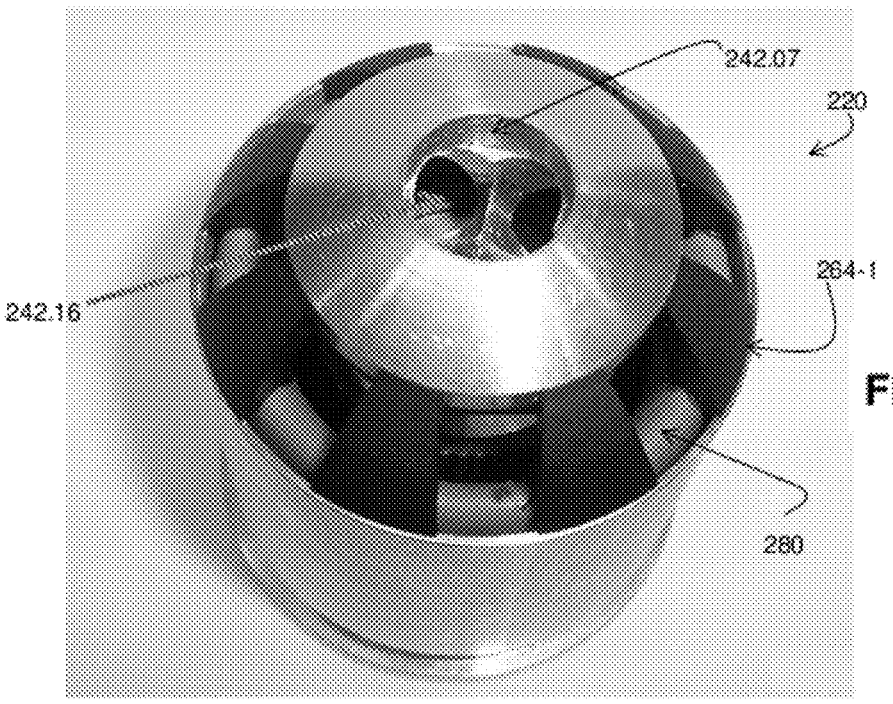
FIG. 26 is a top prospective photographic view looking down at one of the munitions of FIG. 25.
Figure 27:
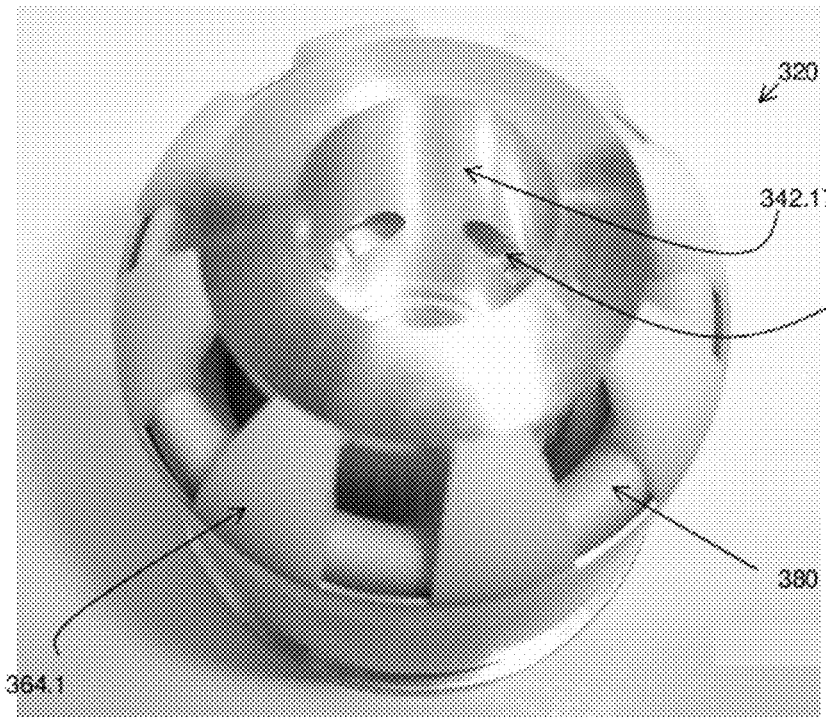
FIG. 27 is a top prospective photographic view looking down at the other munition of FIG. 25.
Figure 28:
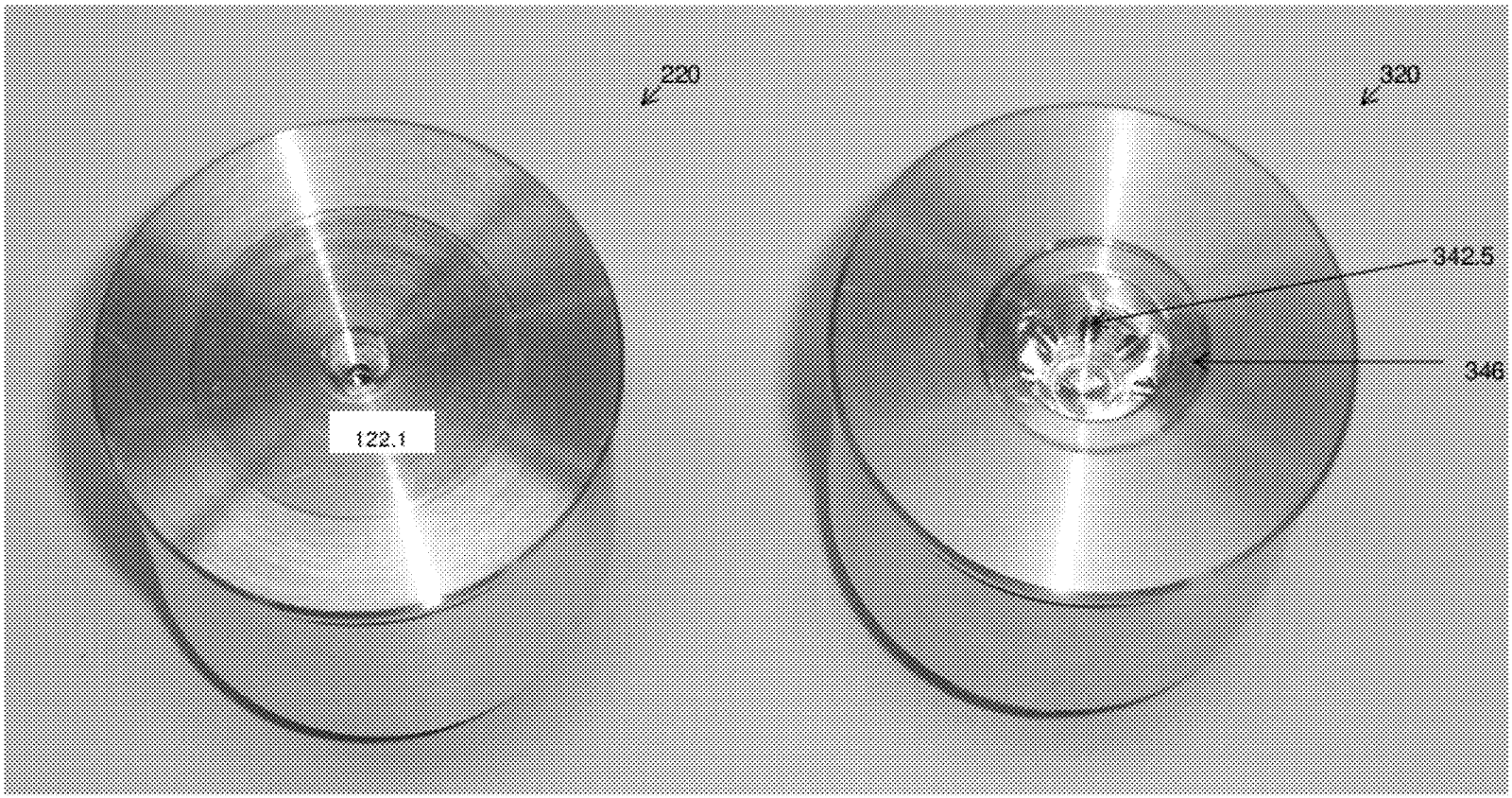
FIG. 28 is a photographic representation looking downward at the bottom sides of the apparatus of FIG. 25.
Figure 29:
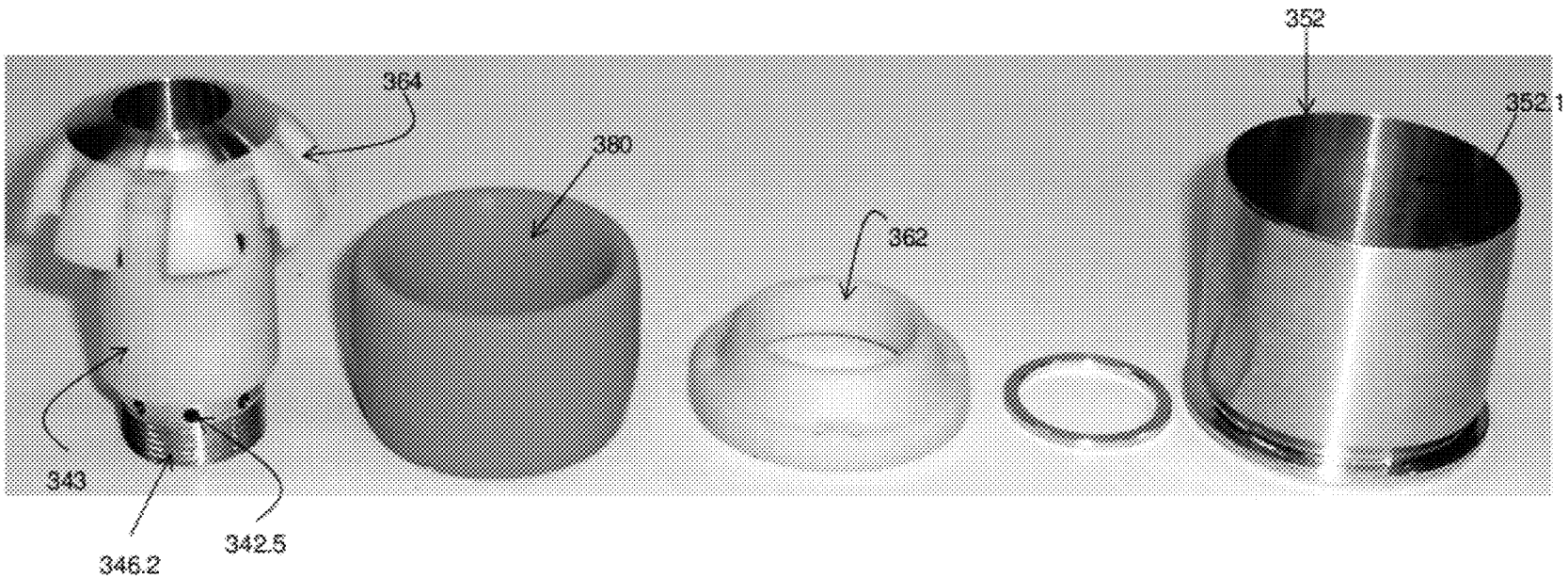
FIG. 29 is a photographic representation of one of the disassembled munitions of FIG. 25.
Figure 30:
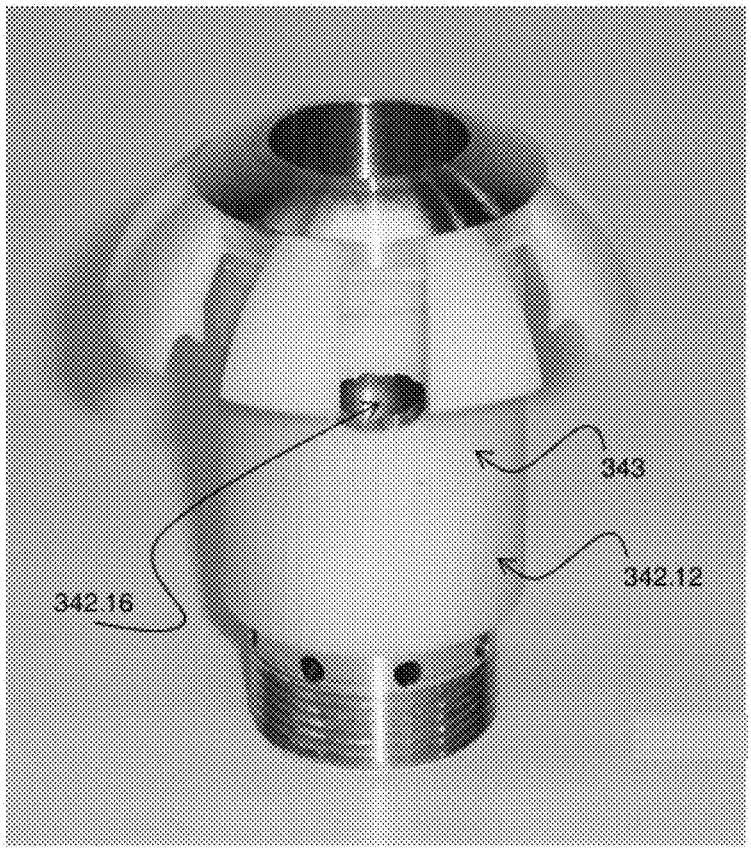
FIG. 30 is a photographic side representation of a portion of the apparatus of FIG. 29.
Figure 31:
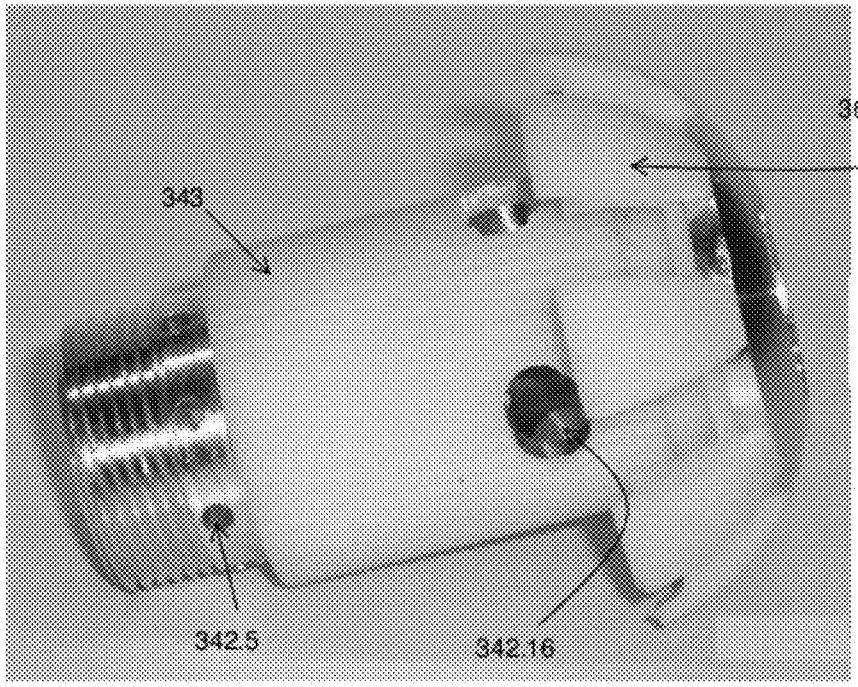
FIG. 31 is a photographic side representation of a portion of the apparatus of FIG. 29.
Figure 32:
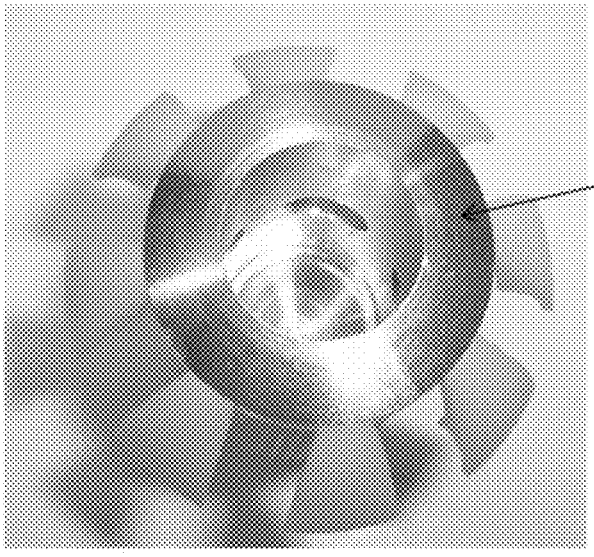
FIG. 32 is a top photographic representation of the apparatus of FIG. 31.
Figure 33:
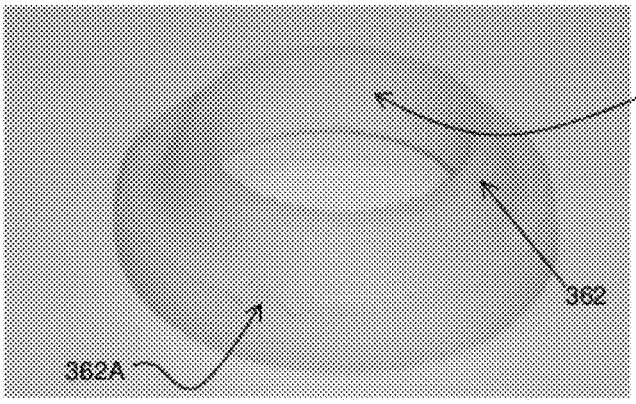
FIG. 33 is a photographic representation of a portion of the apparatus of FIG. 29.
Figure 34:
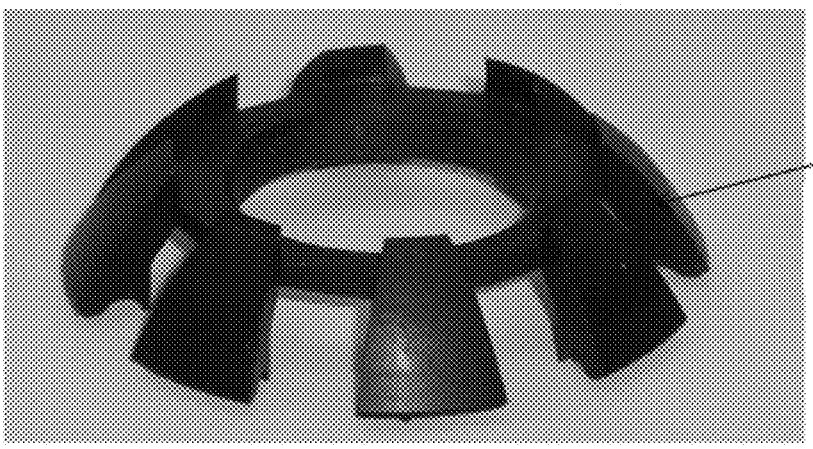
FIG. 34 is a prospective photographic representation of a portion of the apparatus of FIG. 35.
Figure 35:
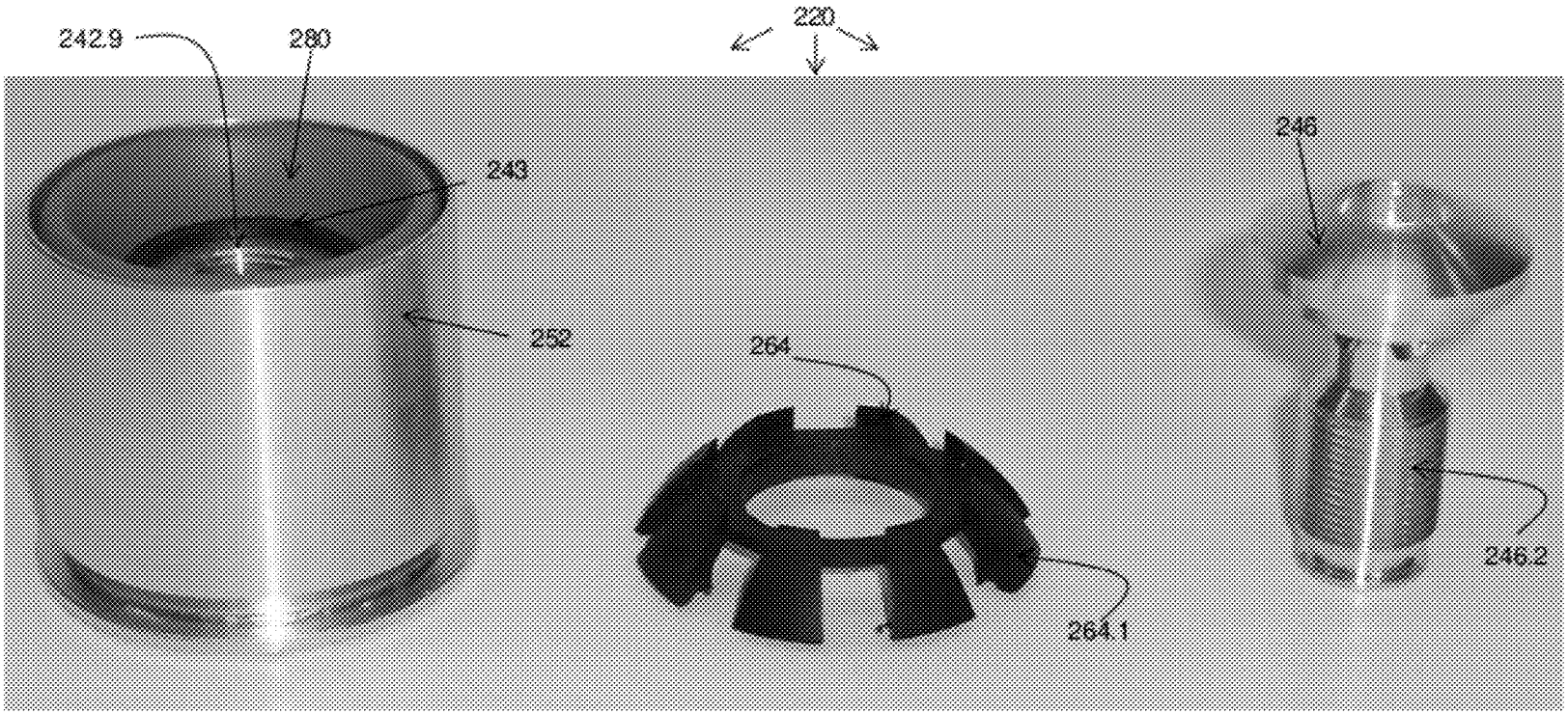
FIG. 35 is a photographic representation of one of the other disassembled munitions of FIG. 25.
Figure 36:
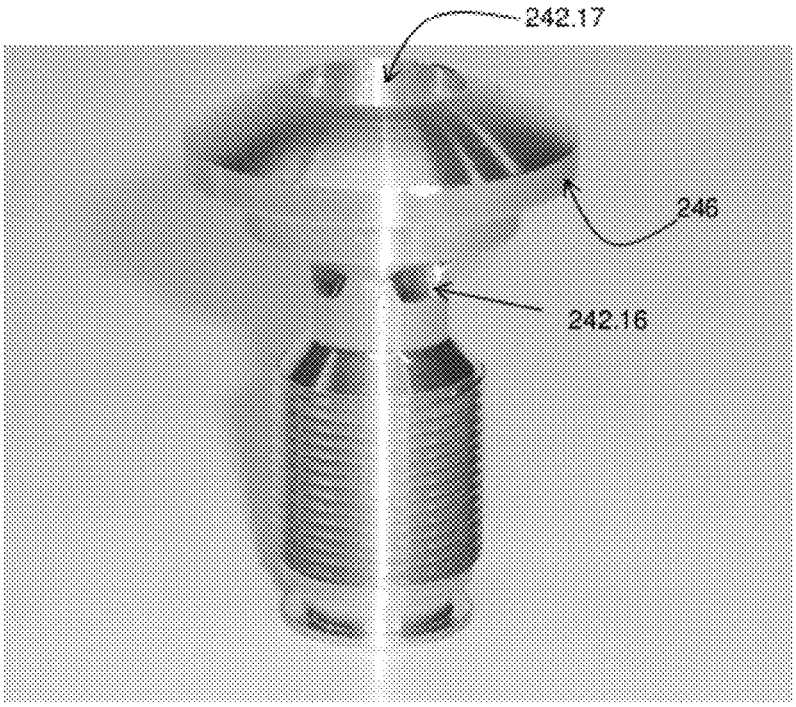
FIG. 36 is a perspective photographic representation of a portion of the apparatus of FIG. 35.
Figure 37:
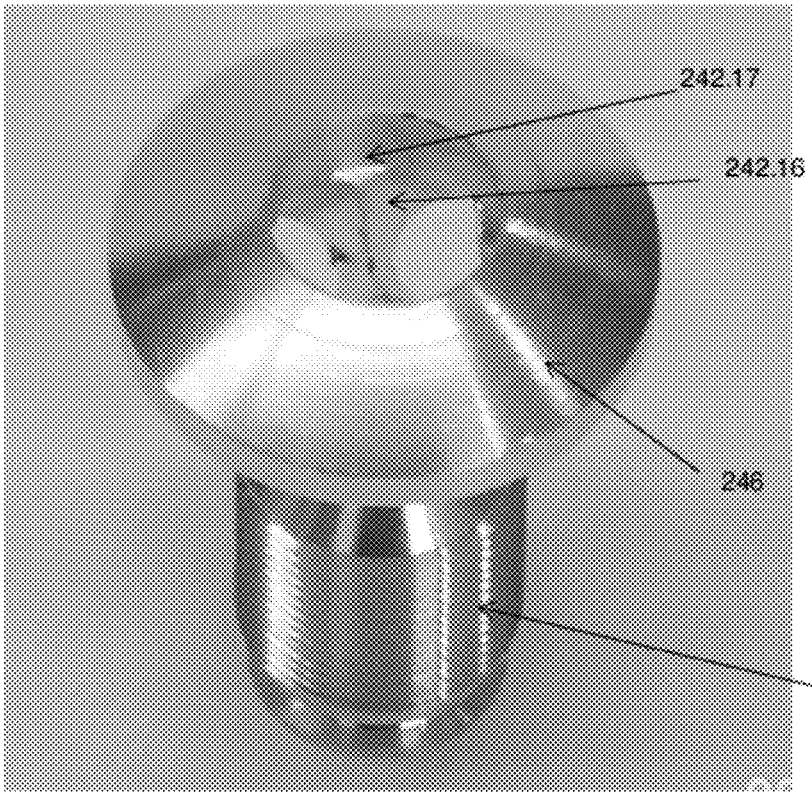
FIG. 37 is a perspective photographic representation of a portion of the apparatus of FIG. 35.

In comparing FIGS. 26 and 27, it can be seen that the vents X42.16 and plenum X42.17 differ from munition 220 to munition 320. For example, vents 242.16 have orientations that form an acute angle with the centerline of munition (as also seen in FIGS. 36 and 37), whereas vents 342.16 have orientations that are substantially perpendicular to the munition central axis. Thus, vents 242.16 impart a longitudinally-directed velocity component into the combustion gas venting into plenum 242.17. Each munition 320 and 220 include six such vents X42.16 that are equally angularly spaced from one another.

Figure 20:
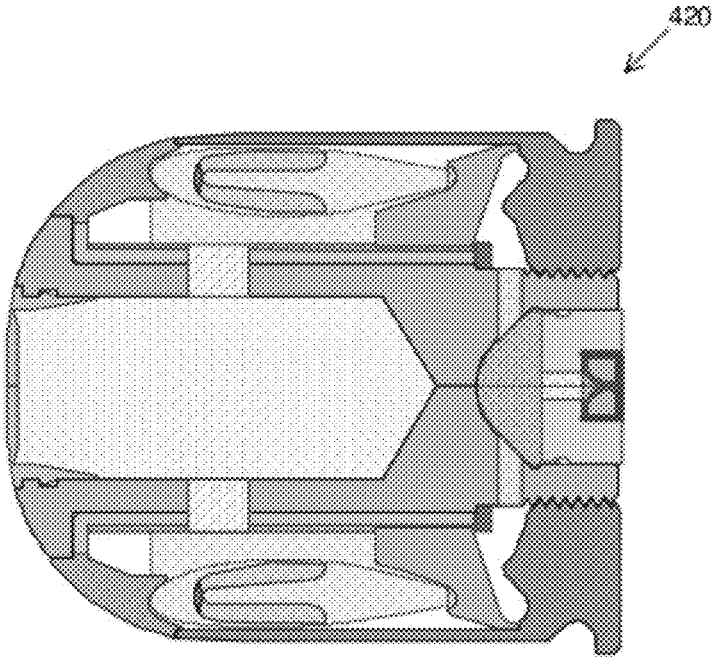
FIG. 20 is a cross-sectional representation of a single shot less lethal munition according to another embodiment of present invention.
Figure 21:
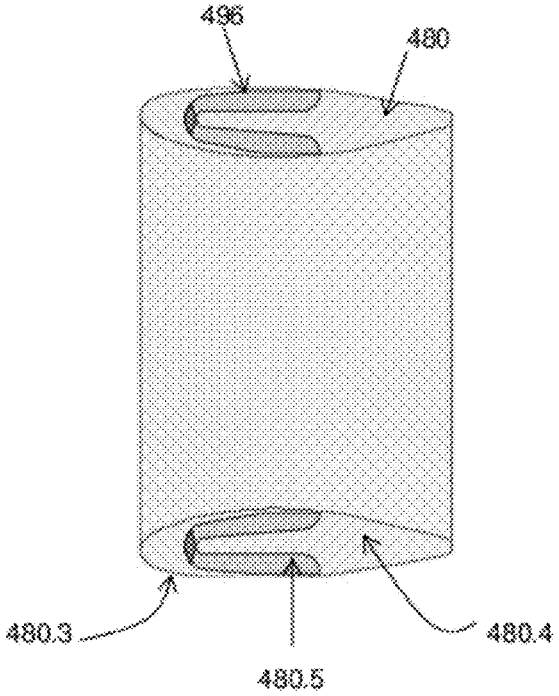
FIG. 21 is a cross-sectional representation of the projectile of FIG. 20.

FIGS. 20 and 21 show a cross sectional view of a munition 420 and a projectile 480, respectively, according to one embodiment of the present invention. FIG. 20 has been substantially drawn to scale. However, this scaling does not impose any limitations on the various embodiments of inventions disclosed herein, unless stated otherwise. Munition 420 is a multifire less lethal munition adapted and configured for firing from a single shot gun similar to munition 220.

Munition 420 includes a ring airfoil projectile 480 that is launched in a manner substantially similar to that of munition 220. Projectile 480 includes an internal chamber 480.5 that contains a first chemical compound 480.6 such as an irritant chemical such as from the family of compounds used in pepper spray. Further placed within internal chamber 480.5 is a second chemical compound 480.7 used to create a fracture within the structurally weaker frangible section 485 of projectile 480. Preferably, second chemical compound 480.7 is combustible upon impact.

Projectile 480 is fabricated from separate forward and rearward portions 480.3 and 480.4, respectively. Preferably, each of these forward and rearward portions are separately molded and machined, and then permanently coupled to each other, such as by application of an adhesive compound or by sonic welding. Forward portion 480.3 includes a generally open interior section substantially concave in shape. Rearward portion 480.4 includes trailing edge 492 at one end, and a cylindrical probe 480.8 that extends forward within chamber 480.5.

The forward and rearward portions 480.3 and 480.4, respectively, are joined together such that there is a frangible section 485 along one or both of the inner surface or outer surface of the projectile 480. Section 485 is adapted and configured to have reduced stiffness when compressed axially, such as by having reduced wall thickness. When projectile 480 is compressed, section 485 permits the forward and aft portions 480.3 and 480.4, respectively, to move closer to one another. The movement is sufficient, during impact of the projectile on a target, for cylindrical probe 480.8 to extend forward within chamber 480.5 and impact and thereby detonate chemical compound 480.7.

Figure 24:
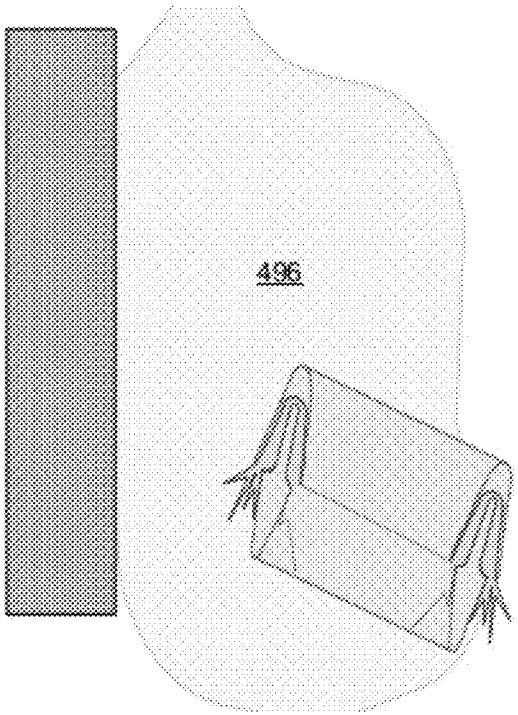
FIG. 24 is a schematic representation of a cloud of irritant and of the projectile descending after hitting the wall.
Figure 23:
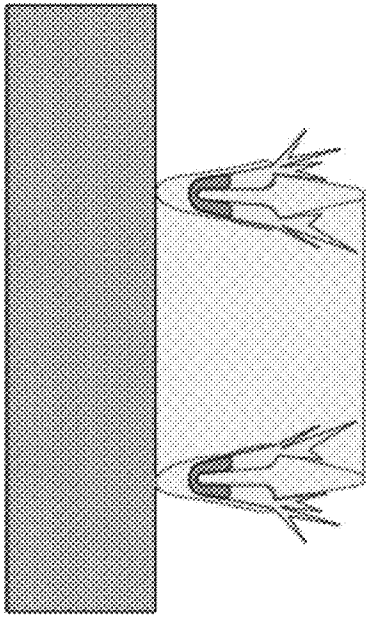
FIG. 23 is a schematic representation of the apparatus of FIG. 22 as the projectile ruptures and releases an irritant into ambient conditions.
Figure 22:
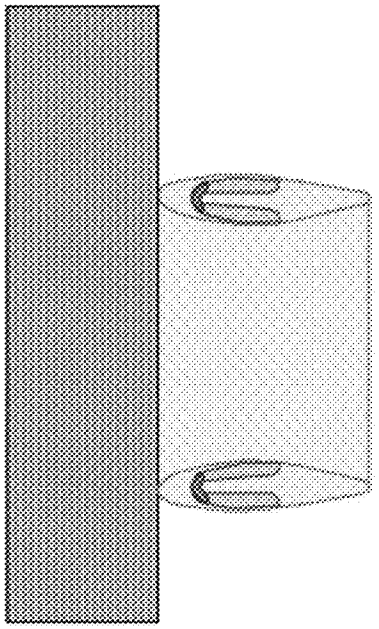
FIG. 22 is a schematic representation of the projectile of FIG. 21 impacting a surface.
Figure 25:
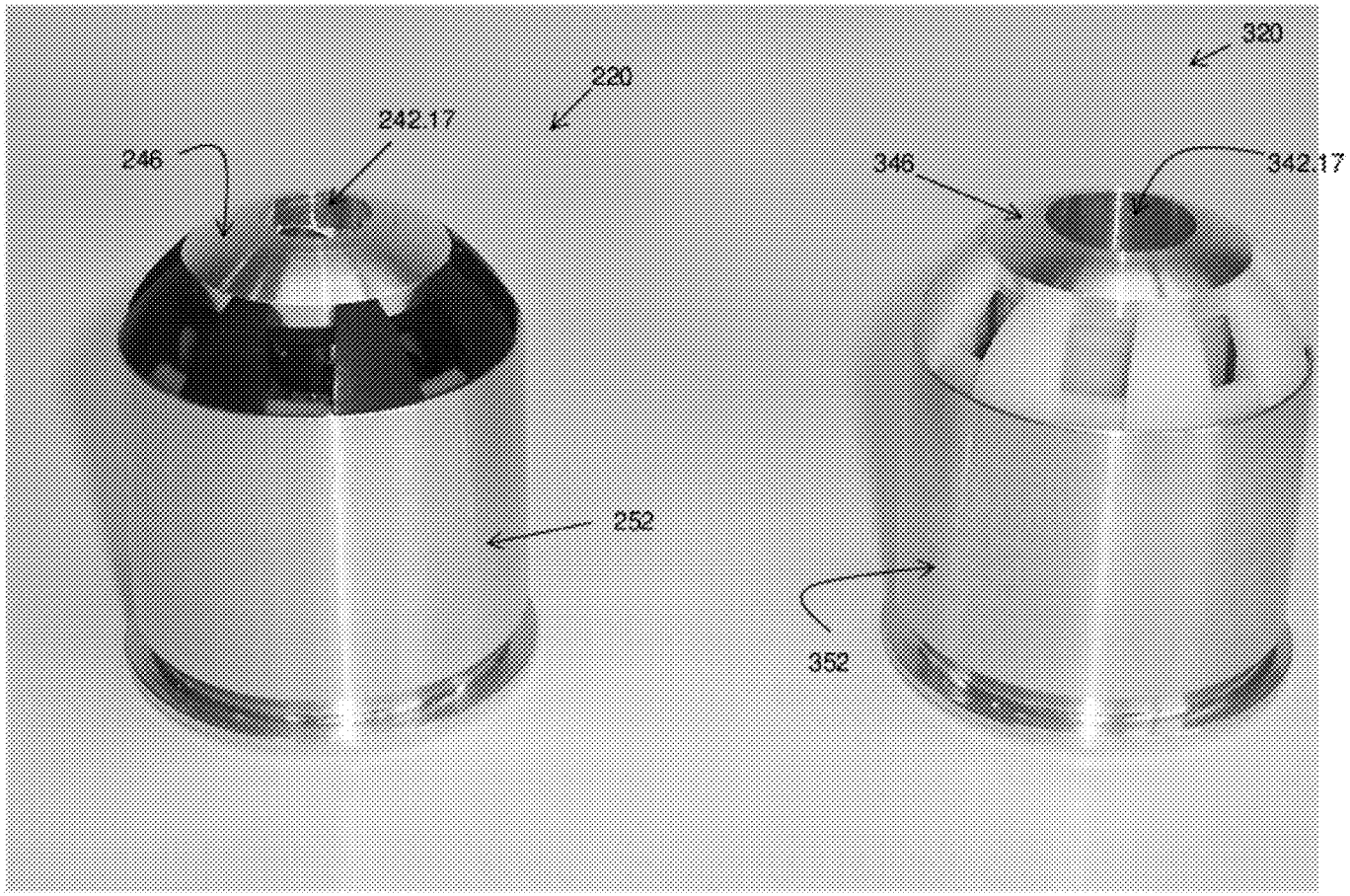
FIG. 25 are photographic representations of single shot munitions according to two embodiments of the present invention.

FIGS. 22, 23, and 24 show the effect of the projectile striking a target. As best seen in FIG. 423, projectile 480-1 strikes a target. Frangible section 485 deforms, probe 480.8 impacts, and This impact causes a chemical reaction within compound 480.7, which suddenly increases the pressure within chamber 480.5. As a result frangible section 485 breaks open. Chamber 480.5-1 is thereby placed in fluid communication with ambient conditions. A cloud 496 of the compound 480.7 is created in the vicinity of the impact site. It is appreciated that in some embodiment the inertial load resulting from deceleration of aft portion 480.4-1 or the change in pressure resulting from the impact upon chemical compound 480.7 are capable separately of rupturing frangible section 485.

FIGS. 38-46 show various apparatus and methods for molding some of the components shown herein. These figures use an element numbering system in which a prefix of "10.X-YY" refers to a mold or mold component 10.X used to mold a component YY. The nomenclature "12.X-YY" refers to a molded or machined aspect 12.X of component YY, but before any final machining or other processing required to produce component YY.

Figure 38:
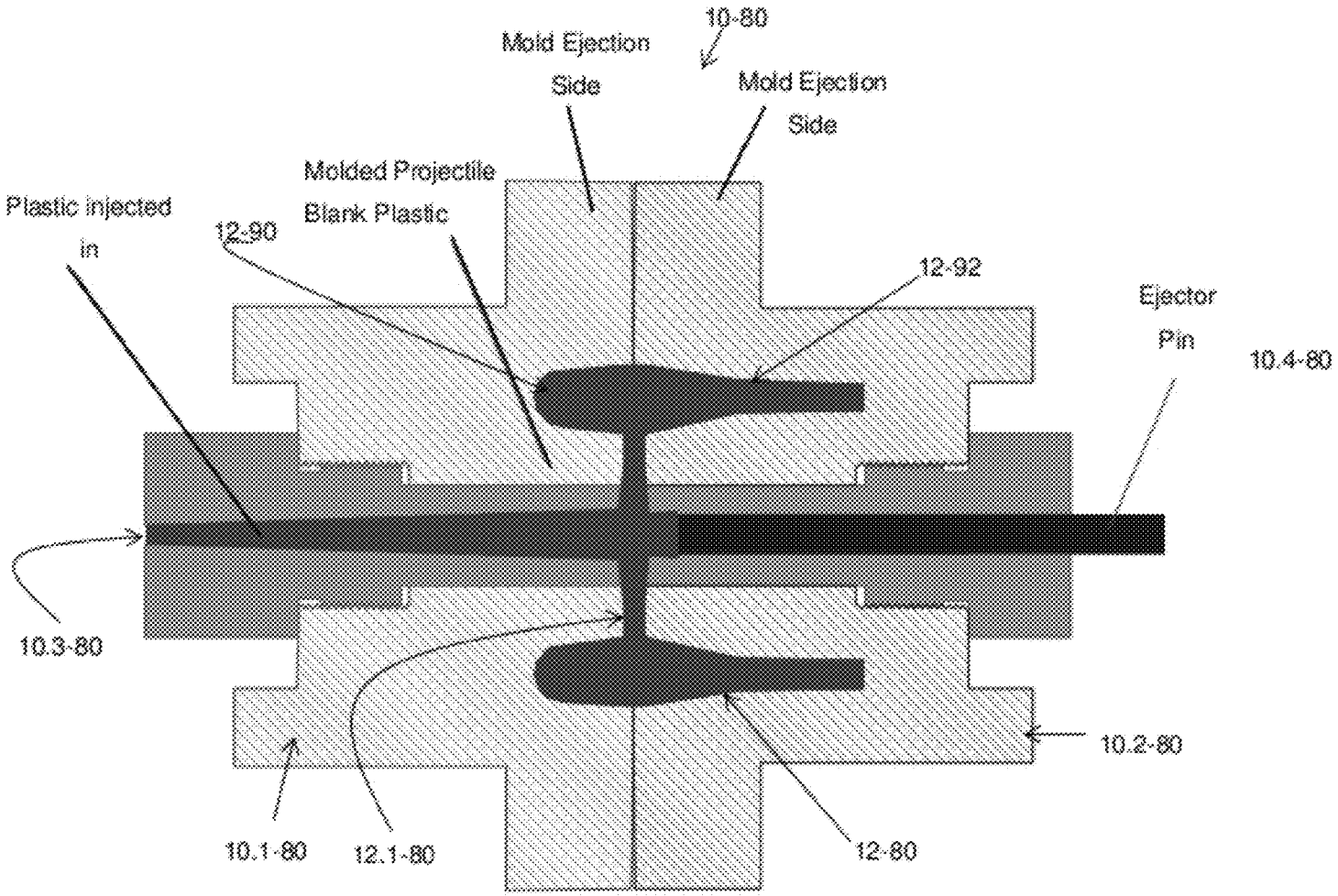
FIG. 38 is a cross-sectional schematic representation of an apparatus for injection molding a projectile according to one embodiment of the present invention.
Figure 41:
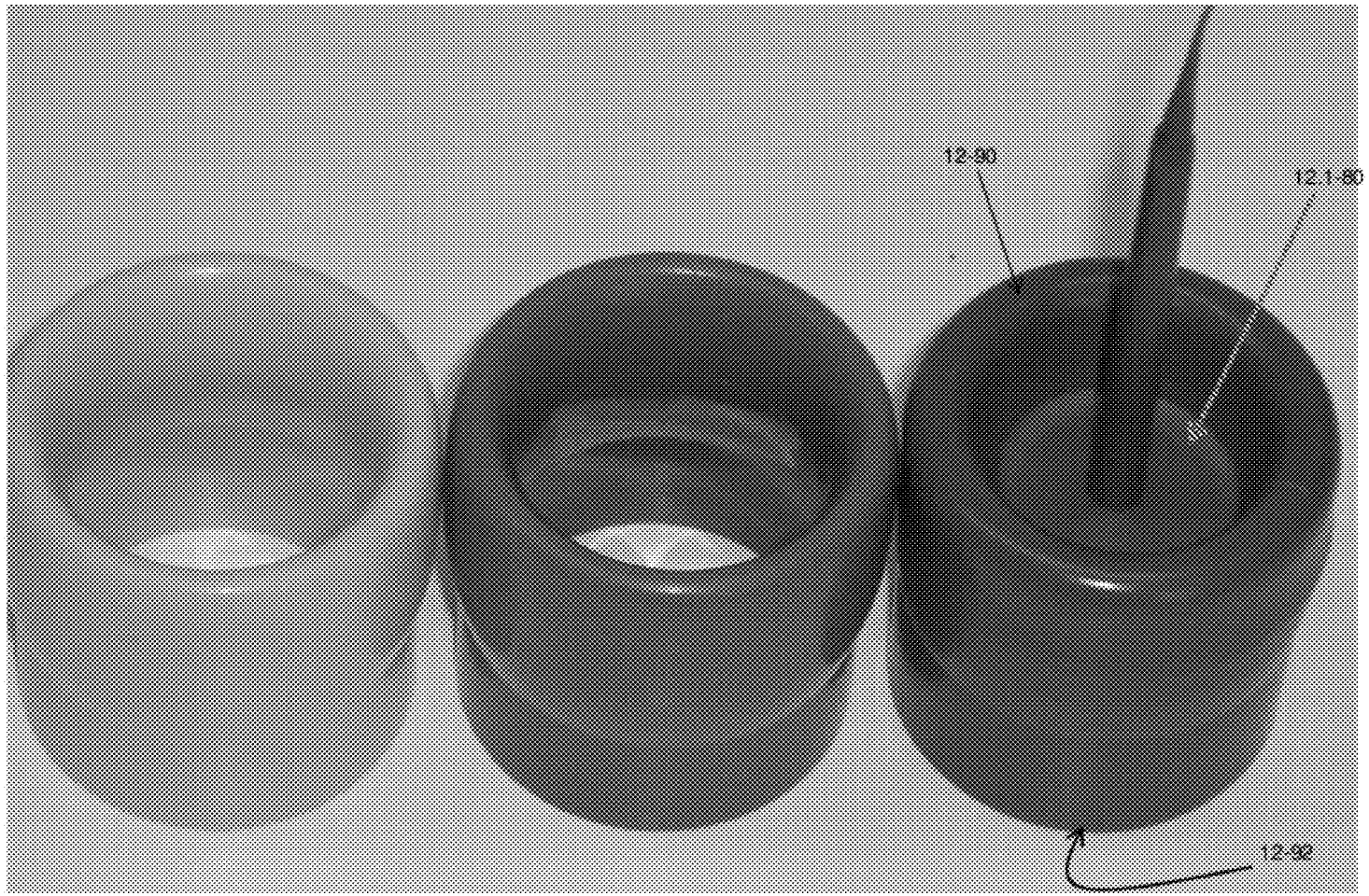
FIG. 41 is a top perspective photographic representation of three molded projectiles according to one embodiment of the present invention.
Figure 42:
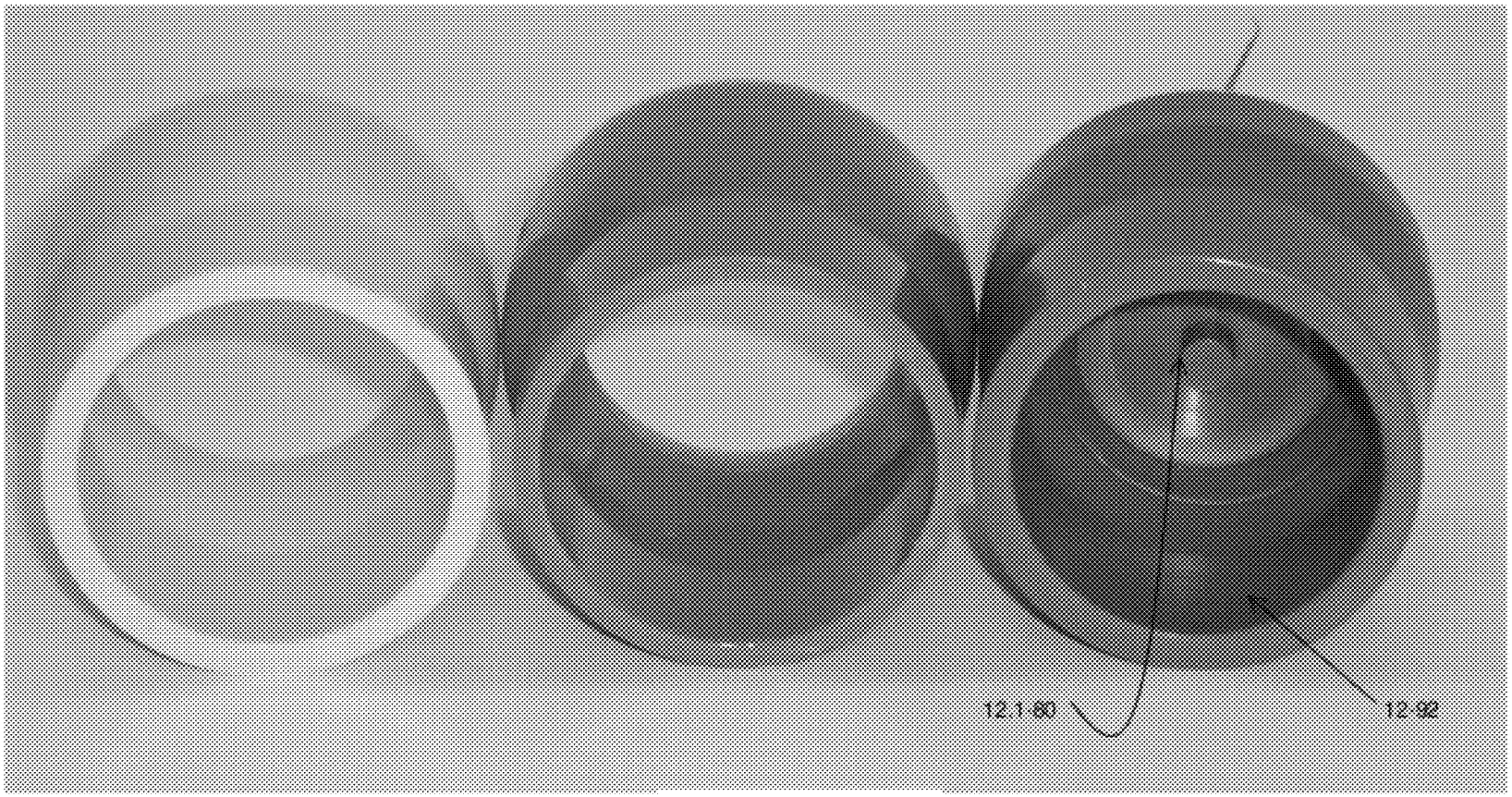
FIG. 42 is a bottom perspective view of the projectile of FIG. 41.

FIG. 38 shows in cross section one embodiment of an inventive method for molding a projectile 80. Mold halves 10.1-80 and 10.2-80 are joined generally along the midsection of projectile 12-80. The mold halves are adapted and configured to introduce the molten plastic through a centrally located annular web 12.1-80 into the inner surface of projectile 12-80. Although FIG. 38 shows the plastic material being introduced from the forward (leading edge) side of projectile 12-80, the present invention also contemplates introducing the material from the rearward (trailing edge) side of projectile 12-80. FIGS. 41 and 42 show a projectile 12-80 is side by side comparison with projectiles molded with the molten plastic having been introduced at discrete points along the outer surface of the components.

Figure 39:
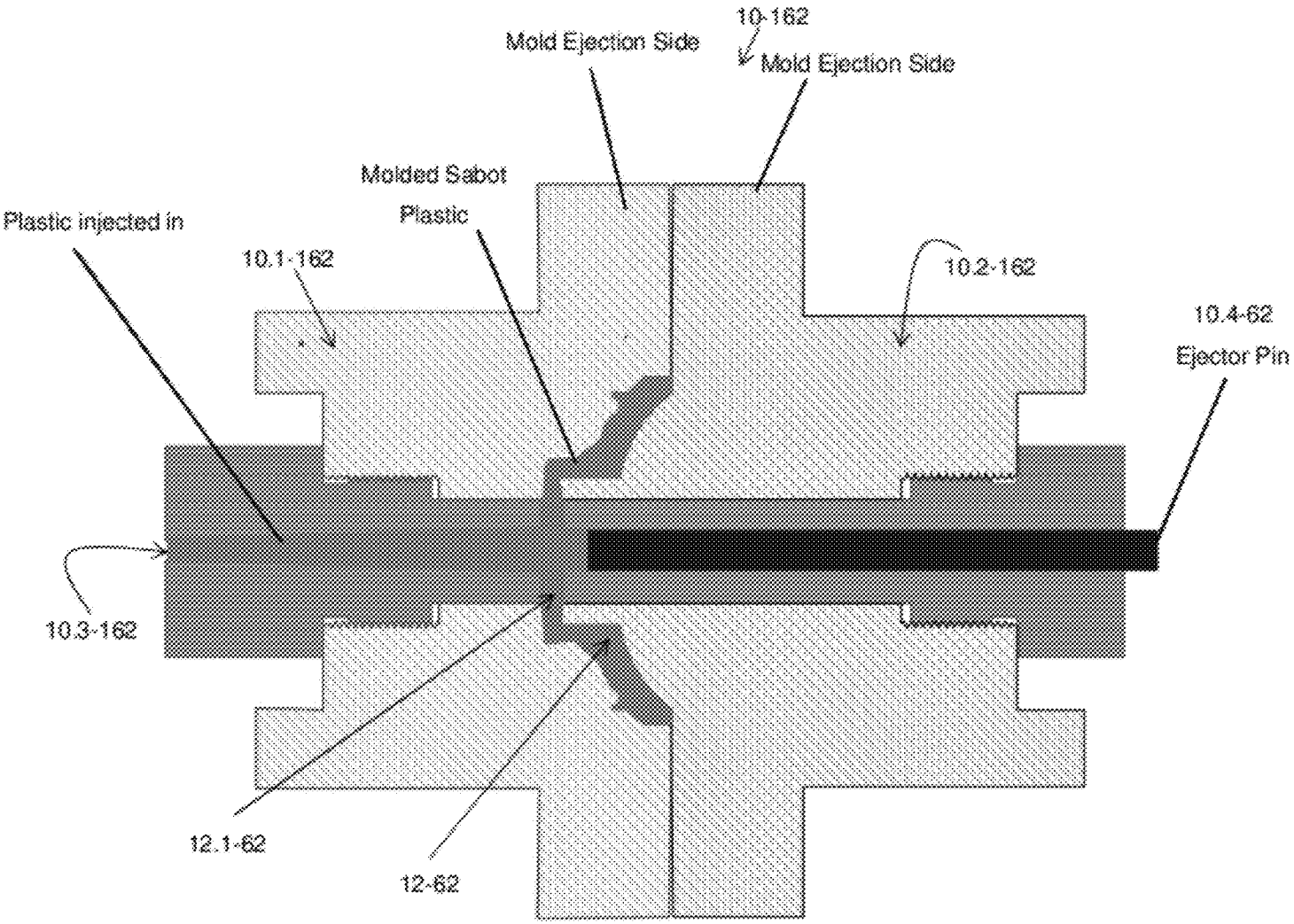
FIG. 39 is a cross-sectional schematic representation of an apparatus for injection molding a sabot according to one embodiment of the present invention.
Figure 43:
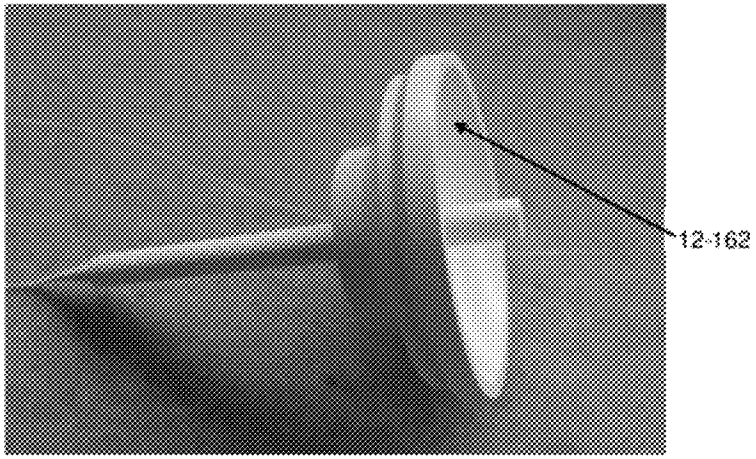
FIG. 43 is a perspective photographic representation of the as-molded sabot of FIG. 39.

FIG. 39 shows in cross section one embodiment of an inventive method for molding a sabot 62. Mold halves 10.1-62 and 10.2-62 are joined generally along the outermost diameter of sabot 12-62. The mold halves are adapted and configured to introduce the molten plastic through an annular web 12.1-62 into the inner surface of sabot 12-62. Although FIG. 39 shows the plastic material being introduced from the forward side of sabot 12-62, the present invention also contemplates introducing the material from the rearward side of sabot 12-62. FIG. 43 show a sabot 12-62.

Figure 40:
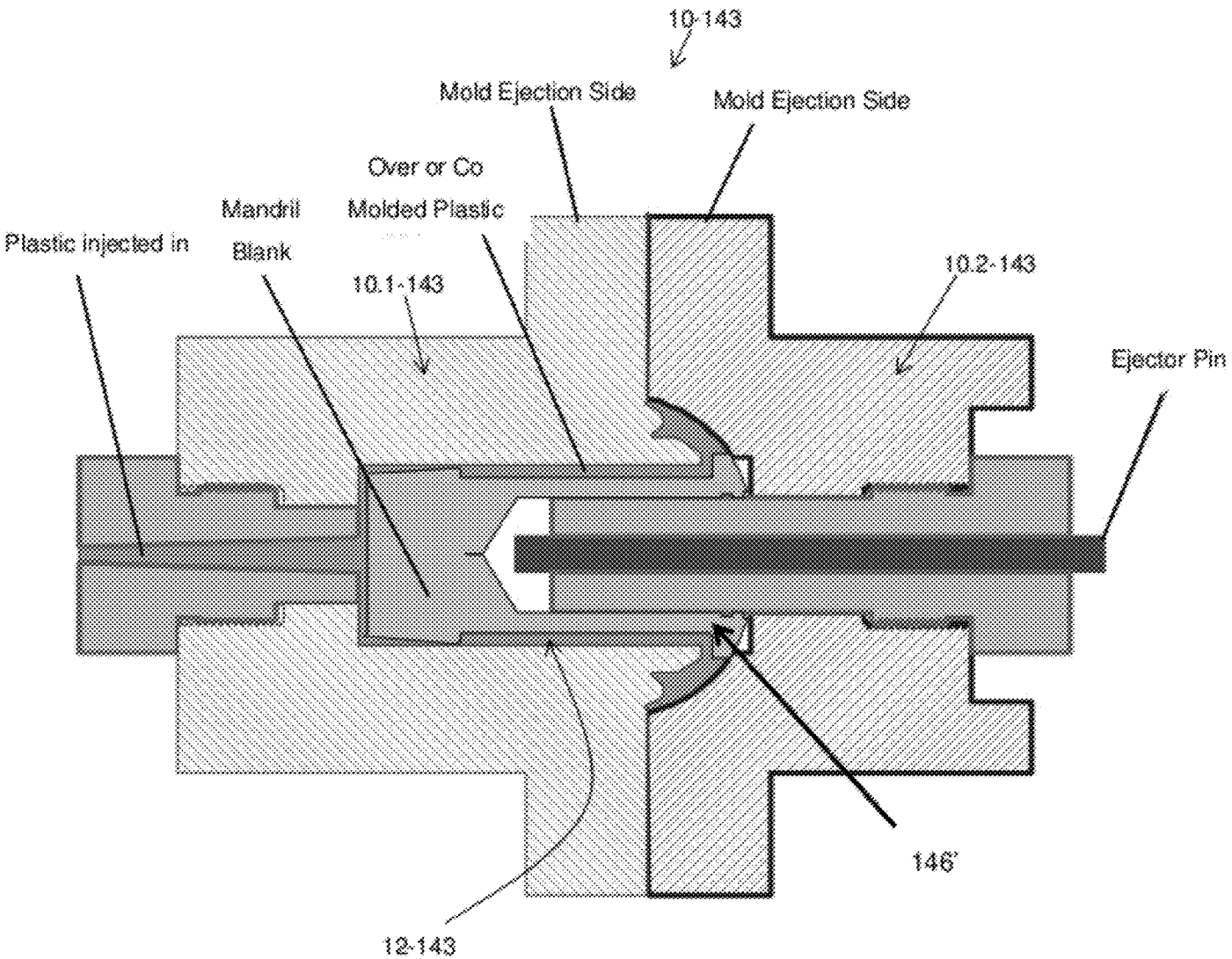
FIG. 40 is a cross-sectional schematic representation of an apparatus for injection molding a molded outer cover according to one embodiment of the present invention.
Figure 45:
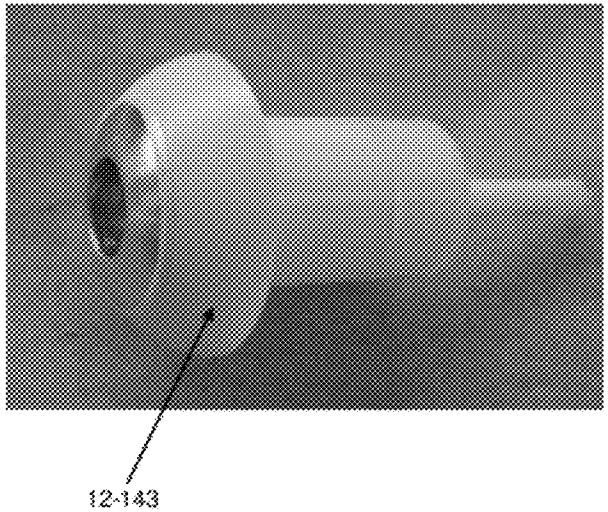
FIG. 45 is a perspective photographic representation of an overmolded cover made with a method according to FIG. 40.
Figure 44:
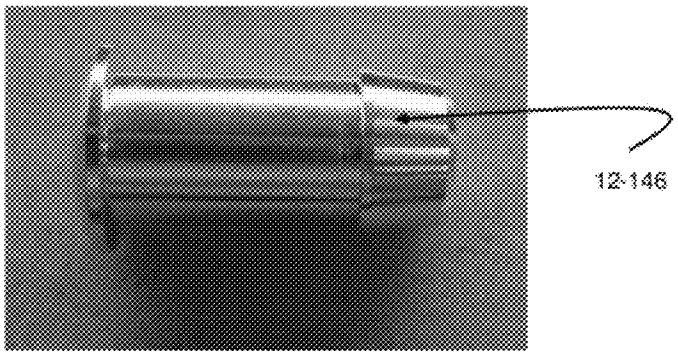
FIG. 44 is a side photographic representation of a fastener prior to overmolding of an outer cover.
Figure 46:
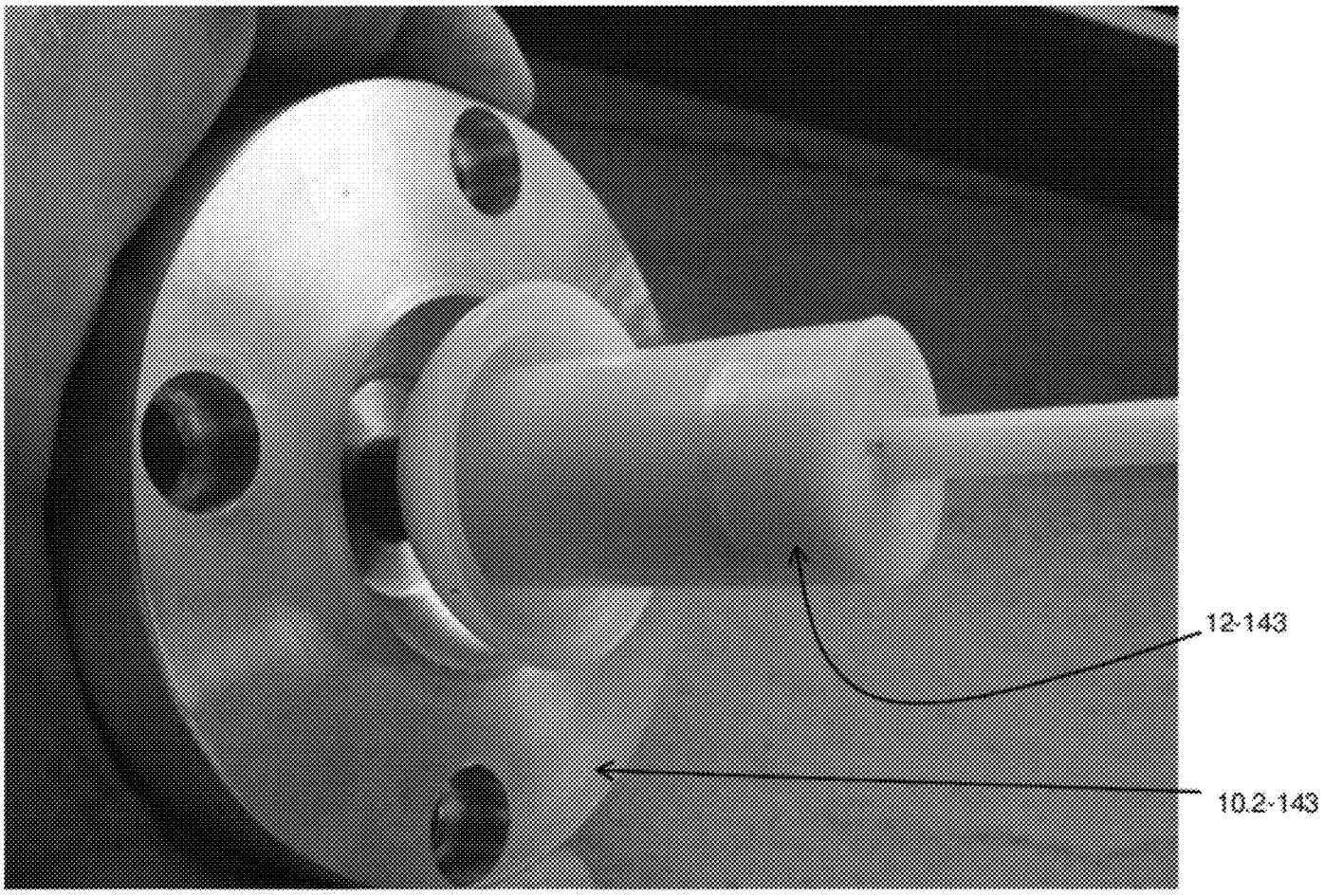
FIG. 46 is a perspective photographic representation of a portion of the mold and the overmolded cover according to the method of FIG. 40.

FIG. 40 shows in cross section one embodiment of an inventive method for molding a cover 143 over a partially processed fastener 146'. Mold halves 10.1-143 and 10.2-143 are joined generally along the outermost diameter retainer 164, which is being shown molding concurrently with cover 12-143. The mold halves are adapted and configured to introduce the molten plastic through an annular web 12.1-143 onto the end of fastener 146' that will later incorporate threaded interface 146.2. Although FIG. 40 shows the plastic material being introduced from the rearward side of cover 12-143, the present invention also contemplates introducing the material from the forward side of cover 12-143. FIGS. 45 and 46 show a cover 12-143 molded over fastener 146'. FIG. 44 shows fastener 146' prior to overmolding.

Figure 47:
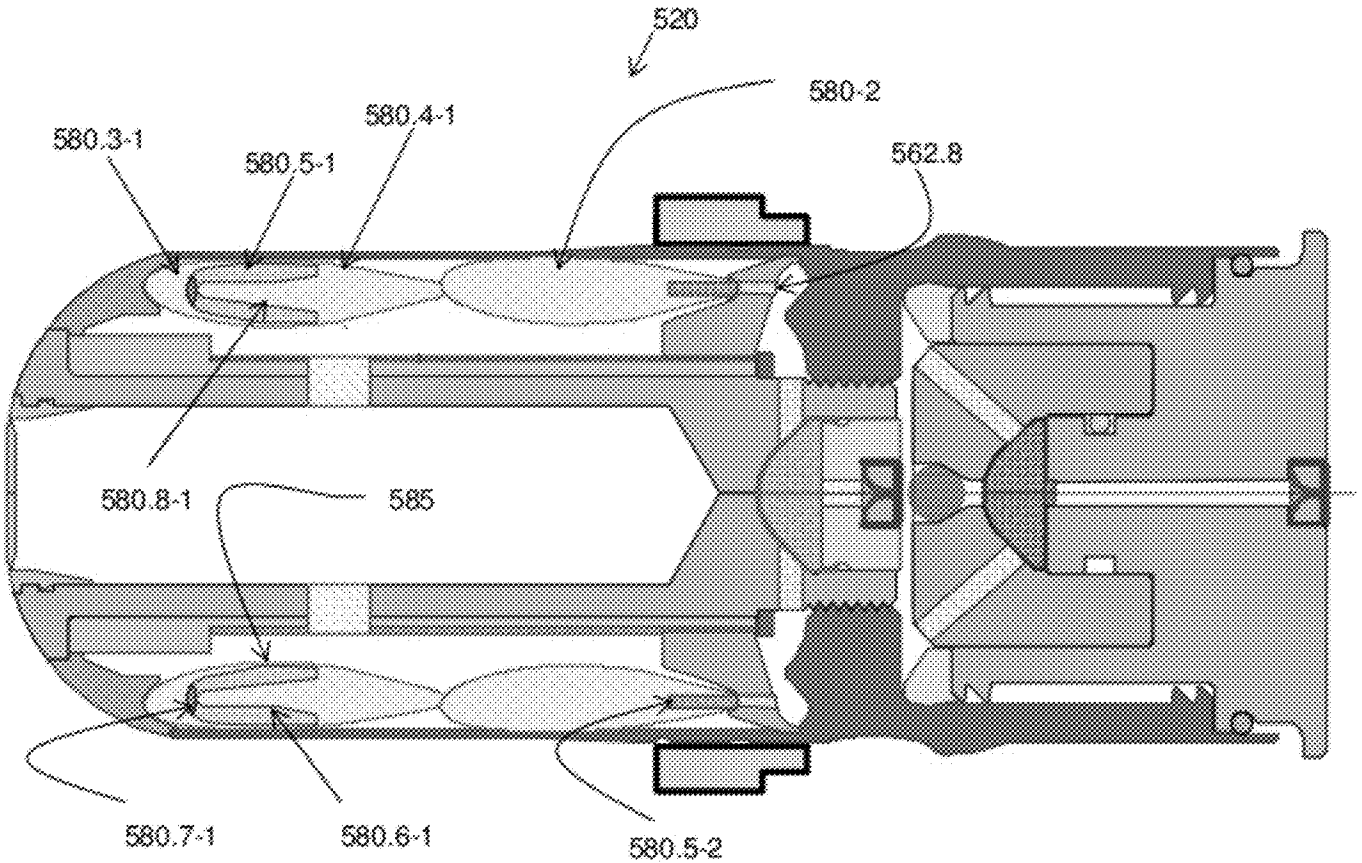
FIG. 47 is a side elevational cross sectional representation of a munition according to another embodiment of the present invention.
Figure 48:
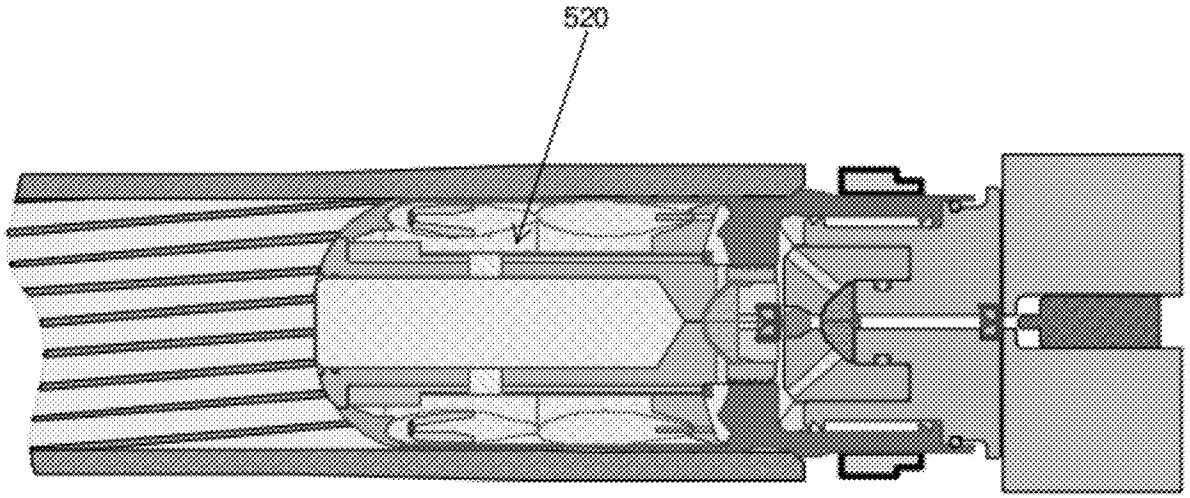
FIGS. 48-53 schematically depict a firing sequence for the apparatus of FIG. 47, similar to the depictions shown in FIGS. 9-14.
Figure 49:
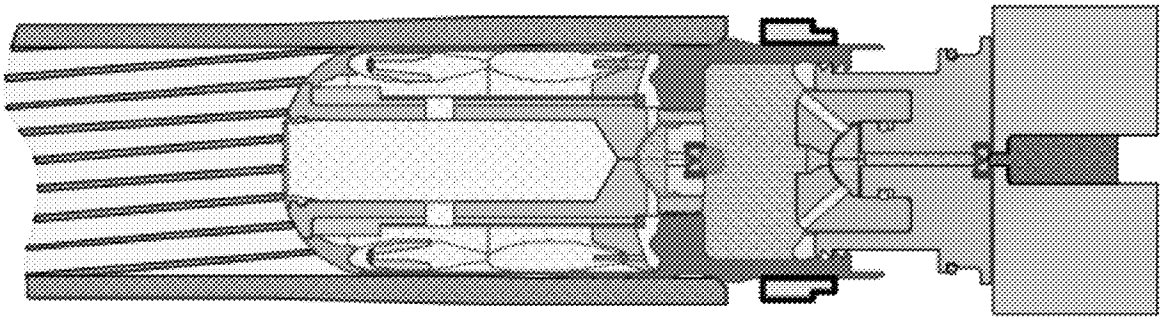
Figure 50:
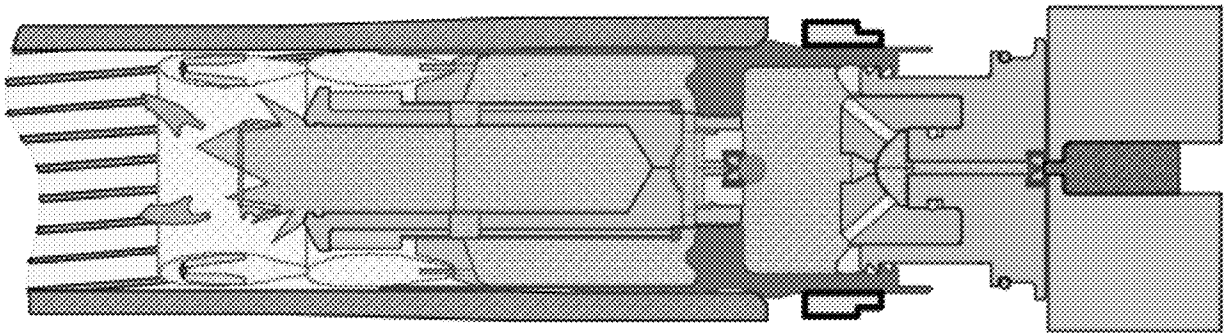

FIG. 47 shows a cross sectional view of a munition 520 according to one embodiment of the present invention. FIG. 47 has been substantially drawn to scale. However, this scaling does not impose any limitations on the various embodiments of inventions disclosed herein, unless stated otherwise. Munition 520 is a multifire less lethal munition adapted and configured for firing from a MK 19 machine gun similar to munition 120.

Munition 520 includes a pair of ring airfoil projectiles 580 that are launched simultaneously in a manner similar to those of munition 120. The projectiles 580 differ in function from each other. Forward projectile 580-1 includes an internal chamber 580.5 that contains a first chemical compound 580.6 such as an irritant chemical such as from the family of compounds used in pepper spray. Further placed within internal chamber 580.5-1 is a second chemical compound 580.7 used to create a fracture within the structurally weaker frangible section 585 of projectile 580-1. Preferably, second chemical compound 580.7 is combustible upon impact.

Projectile 580-1 is fabricated from separate forward and rearward portions 580.3 and 580.4, respectively. Preferably, each of these forward and rearward portions are separately molded and machined, and then permanently coupled to each other, such as by application of an adhesive compound or by sonic welding. Forward portion 580.3 includes a generally open interior section substantially concave in shape. Rearward portion 580.4 includes trailing edge 592 at one end, and a cylindrical probe 580.8 that extends forward within chamber 580.5.

The forward and rearward portions 580.3 and 580.4, respectively, are joined together such that there is a frangible section 585 along one or both of the inner surface or outer surface of the projectile 580-1. Section 585 is adapted and configured to have reduced stiffness when compressed axially, such as by having reduced wall thickness. When projectile 580 is compressed, section 585 permits the forward and aft portions 580.3 and 580.4, respectively, to move closer to one another. The movement is sufficient, during impact of the projectile on a target, for cylindrical probe 580.8 to extend forward within chamber 580.5 and impact and thereby detonate chemical compound 580.7-1.

Projectile 580-2 includes a chamber 580.5 extending annularly around trailing edge 592-2. This annular chamber 580.5 has placed within it a compound 580.6-2 such as black powder that undergoes a chemical reaction to release visible light after the projectile is launched.

Trailing edge 592-2 of projectile 580-2 is received within a recess or pocket that includes a vent 562.8. At the time of launch, hot gas from the combustion chamber expelled through passages 542.5 impinge upon trailing edge 592-2 via vent 562.8. These hot gases begin a chemical reaction within compound 580.6-2.

Figure 51:
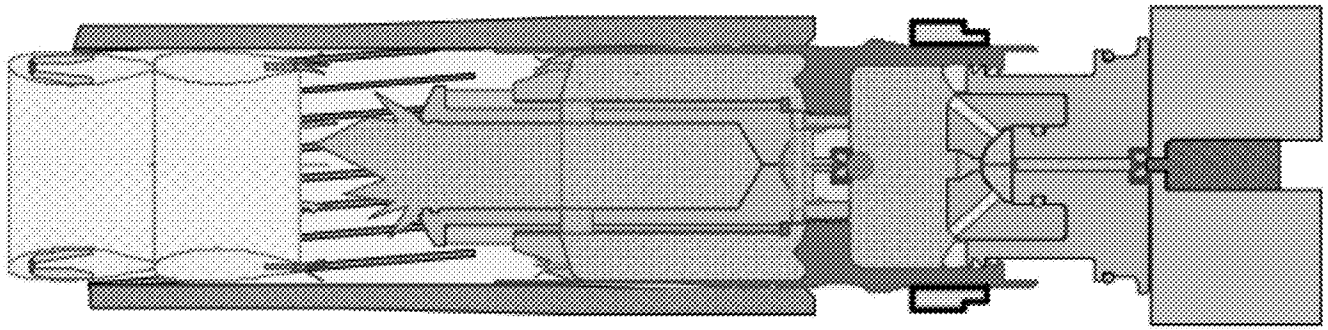
Figure 52:
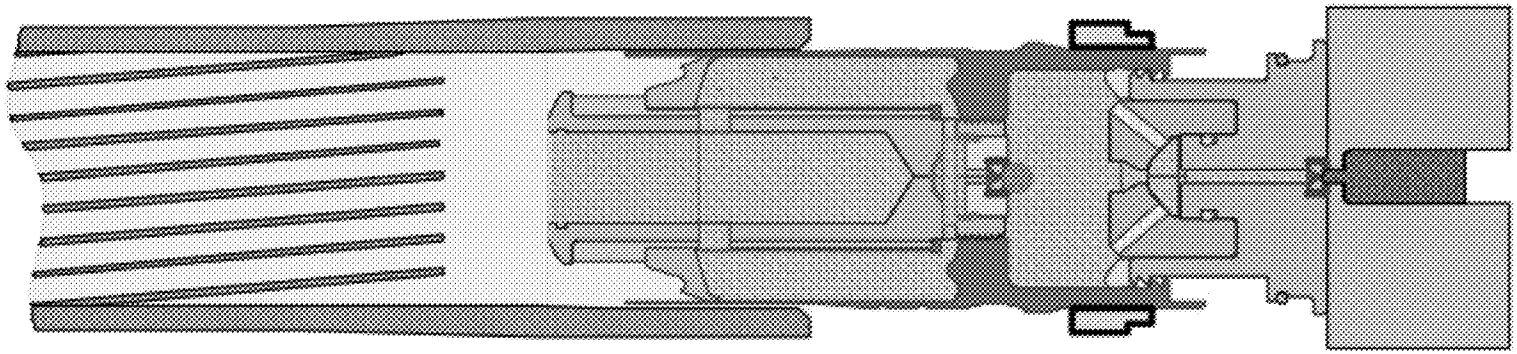
Figure 53:
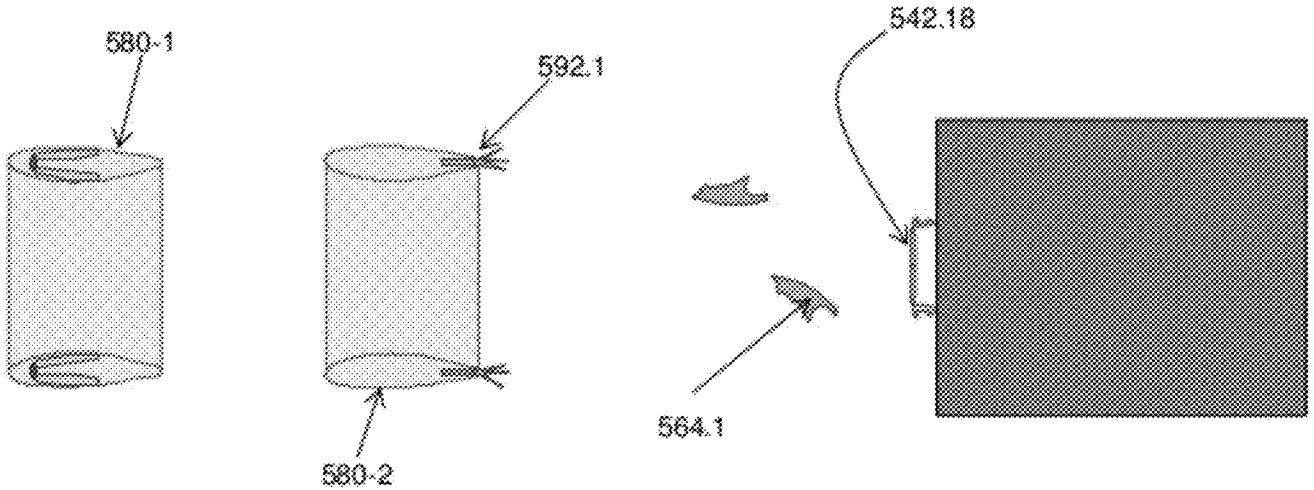

As can be seen in FIG. 51, immediately after launch, projectile 580-2 begins to emit visible light from trailing edge 592. This emission continues after the projectile has left the muzzle, as shown in FIG. 53. This visible light from projectile 580-2 assists the gunner in aiming at the target by providing a tracer effect.

Figure 54:
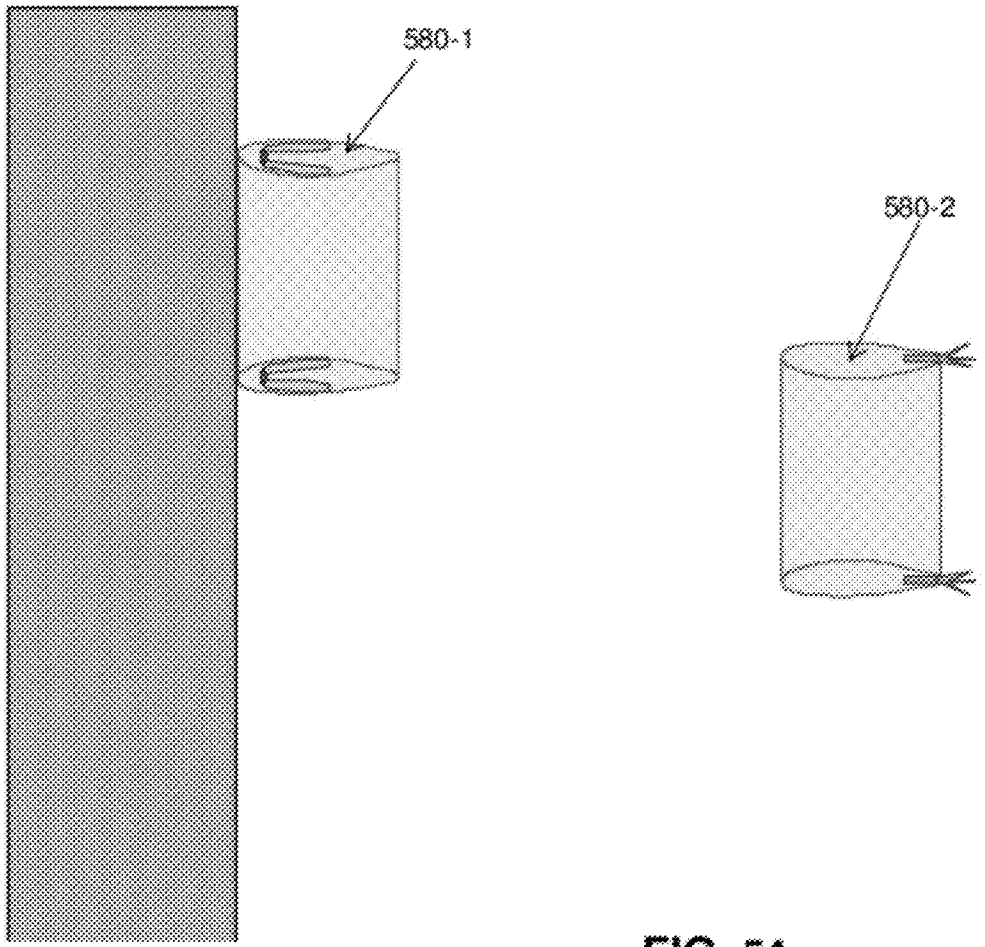
FIGS. 54-55 are schematic representations of the projectiles of FIG. 47 shown impacting a target similar to the depictions of FIGS. 22-24.
Figure 55:
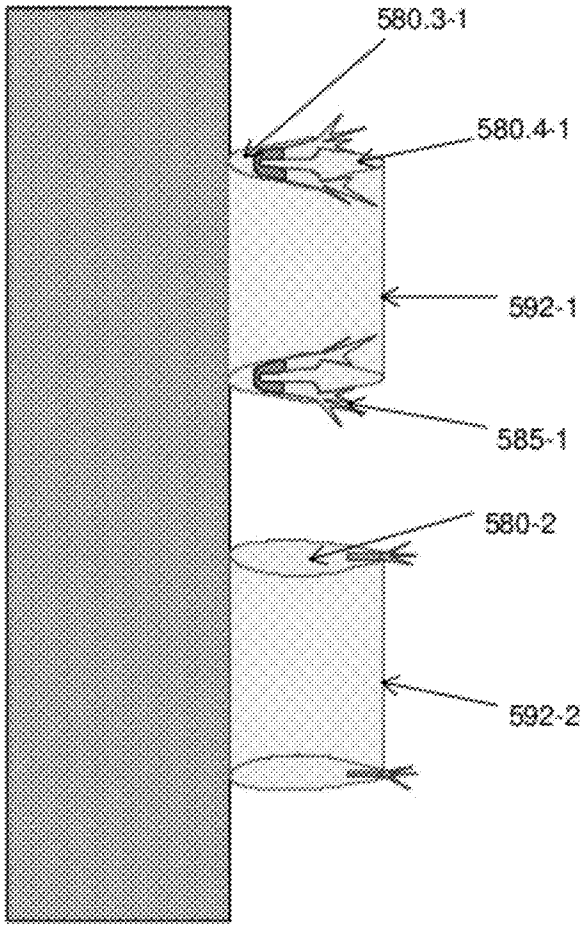
Figure 56:
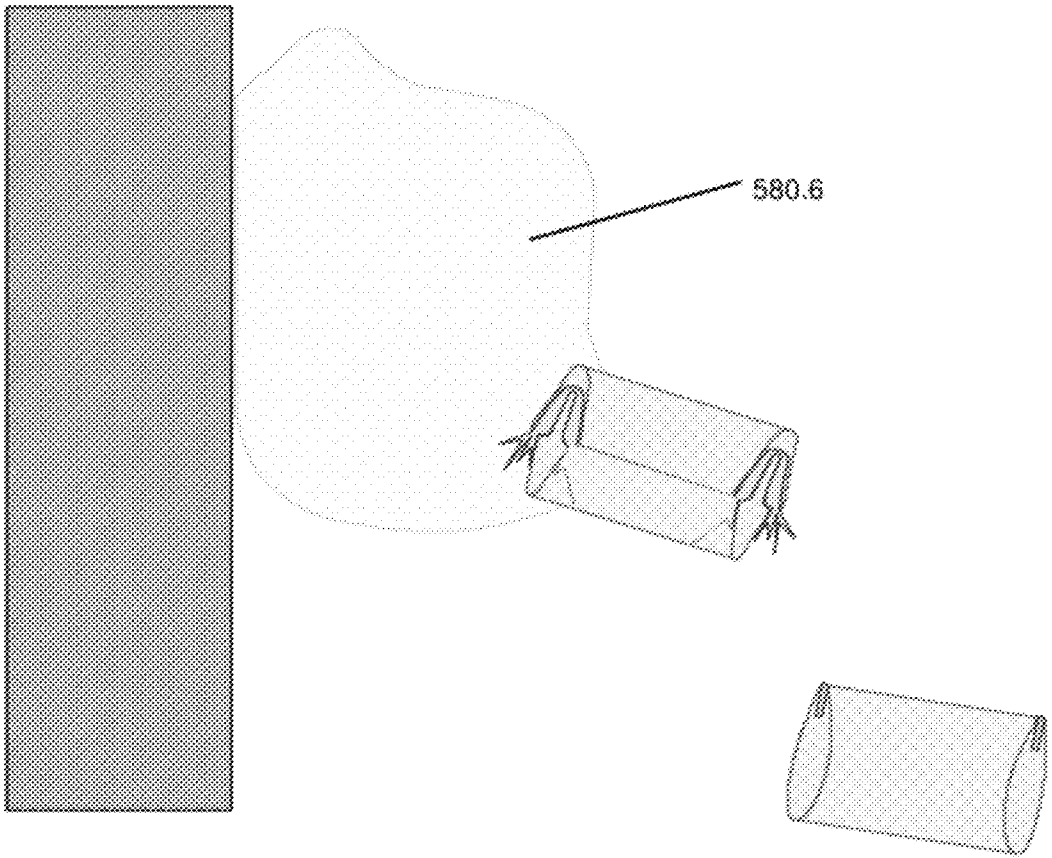

FIGS. 54, 55, and 56 show the effect of the projectiles striking a target. As best seen in FIG. 55, projectile 580-1 strikes a target. Frangible section 585 deforms, probe 580.8 impacts, and this impact causes a chemical reaction within compound 580.7, which suddenly increases the pressure within chamber 580.5. As a result frangible section 585 breaks open. Chamber 580.5-1 is thereby placed in fluid communication with ambient conditions. This increase in pressure likewise is capable of rupturing frangible section 585. It is appreciated that in some embodiment the inertial load resulting from deceleration of aft portion 580.4-1 or the change in pressure resulting from the impact upon chemical compound 580.7 are capable separately of rupturing frangible section 585. A further effect resulting from the sudden increase in the pressure of chamber 580.5 is that the compound 580.6 sprays outwardly into ambient conditions, creating a cloud as best seen in FIG. 56.

Figure 57:
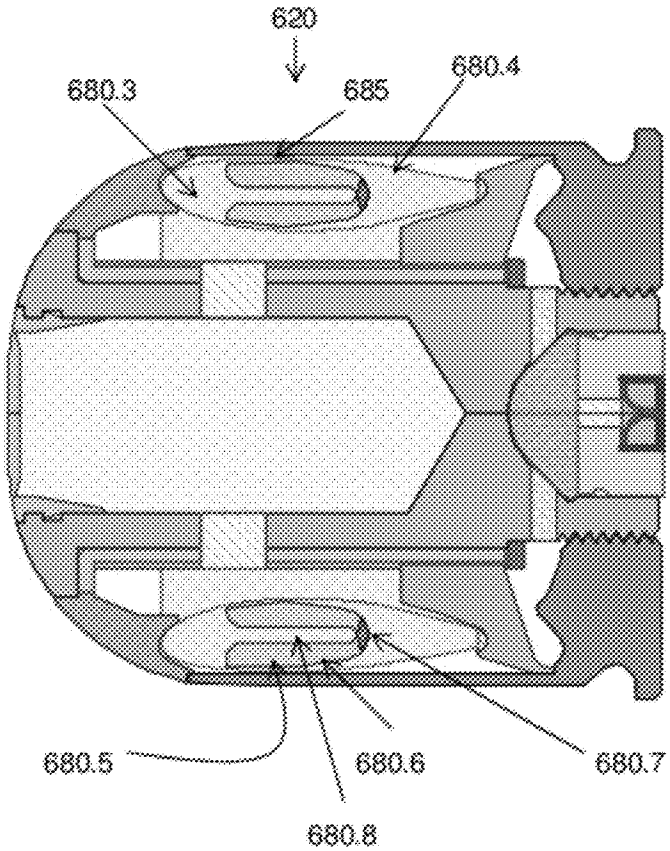
FIG. 57 is a cross sectional representation of a munition according to another embodiment of the present invention.
Figure 58:
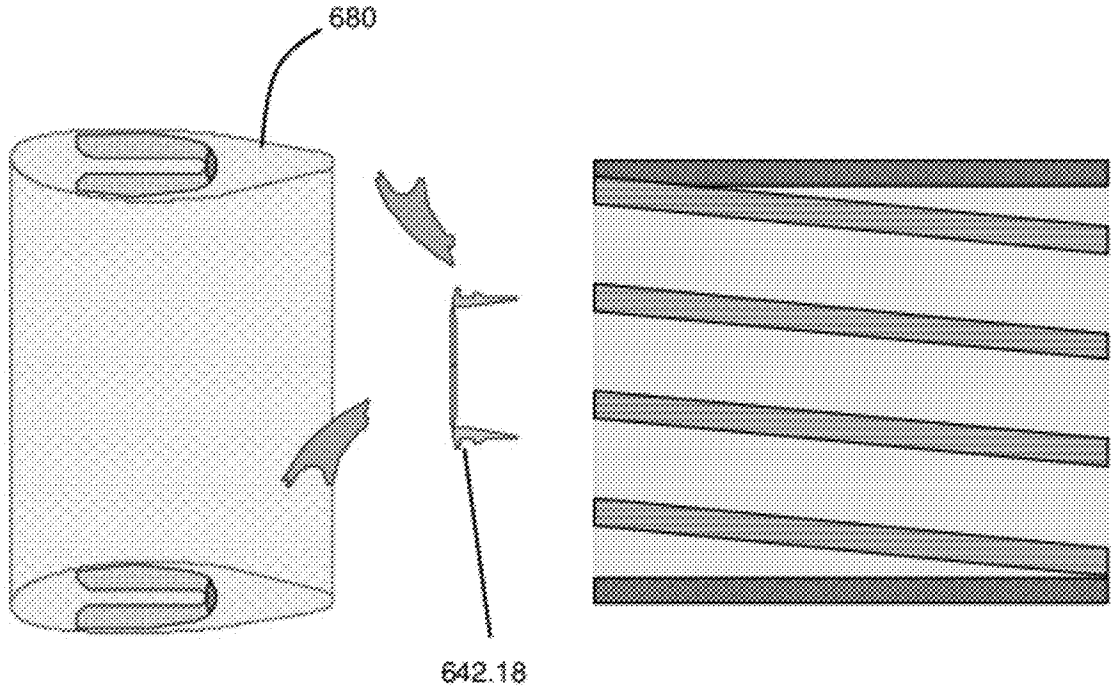
FIGS. 58-61 depict the launching of a projectile from the munition of FIG. 57, with its subsequent impact on a target and release of a chemical compound after impact similar to the depictions of FIGS. 22-24.
Figure 61:
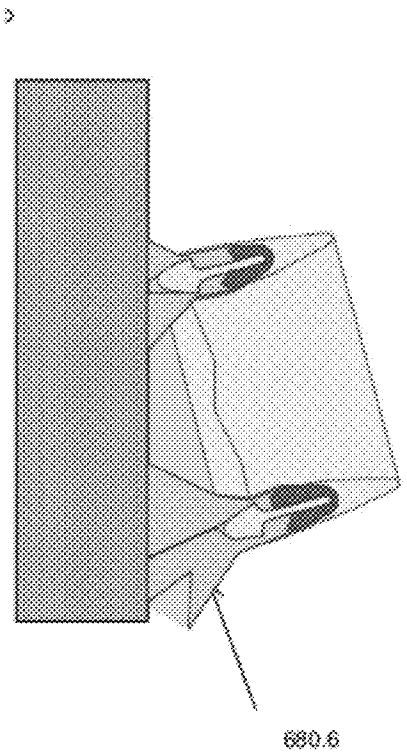

FIG. 57 shows a cross sectional view of a munition 620 and a projectile 680, respectively, according to one embodiment of the present invention. FIG. 57 has been substantially drawn to scale. However, this scaling does not impose any limitations on the various embodiments of inventions disclosed herein, unless stated otherwise. Munition 620 is a multifire less lethal munition adapted and configured for firing from a single shot gun similar to munition 420.

Munition 620 includes a ring airfoil projectile 680 that is launched in a manner similar to that of munition 220. Projectile 680 includes an internal chamber 680.5 that contains a first chemical compound 680.6 such as a marking dye. In some embodiments the marking dye is primarily detectable in non-visible portions of the electromagnetic spectrum, such as ultraviolet. Further placed within internal chamber 680.5 is a second chemical compound 680.7 used to create a fracture within the structurally weaker frangible section 685 of projectile 680. Preferably, second chemical compound 680.7 is combustible upon impact.

Projectile 680 is fabricated from separate forward and rearward portions 680.3 and 680.4, respectively. Preferably, each of these forward and rearward portions are separately molded and machined, and then permanently coupled to each other, such as by application of an adhesive compound or by sonic welding. Rearward portion 680.4 includes a generally open interior section substantially concave in shape. Forward portion 680.3 includes leading edge 690 at one end, and a cylindrical probe 680.8 that extends aft within chamber 680.5.

The forward and rearward portions 680.3 and 680.4, respectively, are joined together such that there is a frangible section 685 along one or both of the inner surface or outer surface of the projectile 680. Section 685 is adapted and configured to have reduced stiffness when compressed axially, such as by having reduced wall thickness. When projectile 680 is compressed, section 685 permits the forward and aft portions 680.3 and 680.4, respectively, to move closer to one another. The movement is sufficient, during impact of the projectile on a target, for cylindrical probe 680.8 to extend rearward within chamber 680.5 and impact and thereby detonate chemical compound 680.7.

Figure 60:
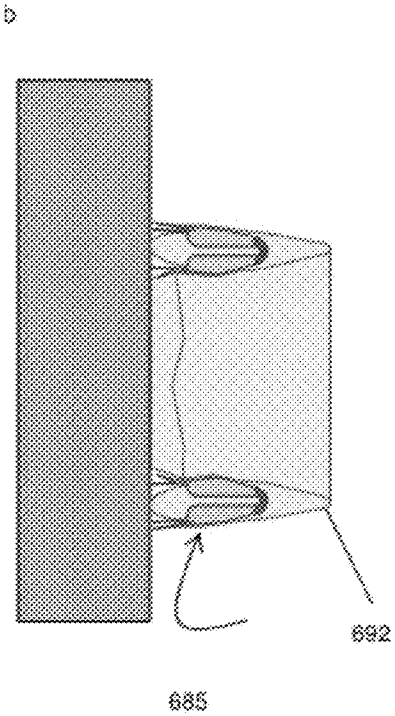
Figure 59:
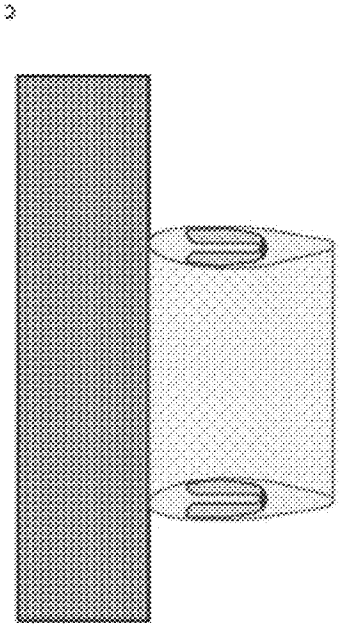

FIGS. 58-61 show the effect of the projectile 680 striking a target. As best seen in FIG. 60, projectile 680-1 strikes a target. Frangible section 685 deforms, probe 680.8 impacts compound 680.7, and this impact causes a chemical reaction within compound 680.7, which suddenly increases the pressure within chamber 680.5. As a result frangible section 685 breaks open. Chamber 680.5-1 is thereby placed in fluid communication with ambient conditions. A cloud 696 of the compound 680.7 is created in the vicinity of the impact site. It is appreciated that in some embodiments the inertial load resulting from deceleration of aft portion 680.4-1 or the change in pressure resulting from the impact upon chemical compound 680.7 are capable separately of rupturing frangible section 685.

What follows are paragraphs that express particular embodiments of the present invention. In those paragraphs that follow, the element numbers are prefixed with an "X" indicating that the words pertain to any of the like-numbered features shown in the drawings or described in the text.

Y1. A munition (X20), comprising a sabot (X62), retainer (X64) spaced apart from said sabot; and a first projectile (X80-1) and a second projectile (X80-2) located in the space between said sabot and retainer, each said projectile having a forward end (X90) and an aft end (X92); wherein said first and second projectiles are aligned in series, with the forward end of said first projectile being in contact with said retainer, the aft end of said second projectile being in contact with said sabot, and the aft end of said first projectile being in contact with the forward end of said second projectile.

Y2. A projectile (X80-2), comprising a ring shaped member having the cross sectional shape of an airfoil, said member having a leading edge (X90) and a trailing edge (X92); wherein the leading edge is adapted and configured to securely couple with the trailing edge of another said projectile (X80-1).

Y3. A method of launching a projectile, comprising providing a source of compressed gas, a projectile, a guide (X42.7) having a length and including an aperture (X41.16) in fluid communication with an internal chamber (X42.17), and a sabot slidable along the length of the guide; releasing compressed gas into a volume (X62.5) bounded in part by a surface of the sabot; propelling the sabot along the guide by said releasing; pushing the projectile by the propelled sabot; venting gas from the volume through the aperture and into the internal chamber; and stopping the sabot along the length of the guide.

Further embodiments include any of the features in paragraphs Y1, Y2, or Y3, and further including wherein each said projectile is in the shape of a ring. Still further embodiments include wherein the cross sectional shape of each said projectile is in the shape of an airfoil. Still further embodiments include wherein each said ring includes a substantially open inner volume (X86).

Further embodiments include any of the features in paragraphs Y1, Y2, or Y3, and which further comprises a central rod (X42.7) that slidingly engages said sabot. Still further embodiments include wherein said retainer is coupled to said rod.

Further embodiments include any of the features in paragraphs Y1, Y2, or Y3, and which further comprises a cylindrical housing (X52), each of said first and second projectiles being contained within said housing.

Further embodiments include any of the features in paragraphs Y1, Y2, or Y3, and wherein the leading edge includes at least one of either a male feature or a female feature, and the trailing edge includes at least one of the other of the male feature or the female feature.

Further embodiments include any of the features in paragraphs Y1, Y2, or Y3, and wherein the leading edge includes a first surface having a shape complimentary to a second surface of the trailing edge. Still further embodiments include wherein the first surface is generally concave and the second surface is generally convex. Still further embodiments include wherein the first surface is generally convex and the second surface is generally concave.

Further embodiments include any of the features in paragraphs Y1, Y2, or Y3, and wherein the leading edge is adapted and configured to provide a torque to the trailing edge for spinning of the other said projectile by the one said projectile.

Further embodiments include any of the features in paragraphs Y1, Y2, or Y3, and wherein the inner surface (X84) of the ring shape is more cambered than the outer surface (X82) of the ring shape.

Further embodiments include any of the features in paragraphs Y1, Y2, or Y3, and wherein said stopping is after said venting.

Further embodiments include any of the features in paragraphs Y1, Y2, or Y3, and wherein the projectile is in the shape of a ring.

Further embodiments include any of the features in paragraphs Y1, Y2, or Y3, and wherein the guide has a generally consistent external shape (X42.8) along its length, the sabot defines an internal shape (X62.2) complimentary to the external shape. Further embodiments include wherein the internal shape of the sabot substantially seals against the external shape of the guide, except proximate to the aperture.

Further embodiments include any of the features in paragraphs Y1, Y2, or Y3, and wherein the chamber includes a frangible cap (X42.18), and which further comprises pressurizing the chamber by said venting and fracturing the cap by said pressurizing.

Further embodiments include any of the features in paragraphs Y1, Y2, or Y3, and wherein the source one of compressed air or compressed carbon dioxide.

Further embodiments include any of the features in paragraphs Y1, Y2, or Y3, and wherein the source is an explosive charge.

Further embodiments include any of the features and paragraphs Y1, Y2, or Y3, or any of the intervening paragraphs, wherein the munition and the projectile are adapted and configured to be launched from armament having a barrel inner diameter between about 37 mm and 40 mm, including by way of example U.S. Army armaments such as the Mk19 machine gun, the M203 launcher, and the six shot MILKOR launcher, and including munitions in which a single projectile is launched, or multiple projectiles are launched.

While the inventions have been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of launching a projectile, comprising:

providing a source of compressed gas, a projectile, a guide having a length and including an aperture in fluid communication with an internal chamber, and a sabot slidable along the length of the guide;

releasing compressed gas into a volume bounded in part by a surface of the sabot;

propelling the sabot along the guide by said releasing;

pushing the projectile by the propelled sabot;

venting gas from the volume through the aperture and into the internal chamber; and stopping the sabot along the length of the guide;

wherein the projectile is in the shape of a ring.

2. A method of launching a projectile, comprising:

providing a source of compressed gas, a projectile, a guide having a length and including an aperture in fluid communication with an internal chamber, and a sabot slidable along the length of the guide;

releasing compressed gas into a volume bounded in part by a surface of the sabot;

propelling the sabot along the guide by said releasing;

pushing the projectile by the propelled sabot;

venting gas from the volume through the aperture and into the internal chamber; and stopping the sabot along the length of the guide;

wherein the guide has a generally consistent external shape along its length, the sabot defines an internal shape complimentary to the external shape.

3. The method of claim 2 wherein the internal shape of the sabot substantially seals against the external shape of the guide, except proximate to the aperture.

4. A method of launching a projectile, comprising:

providing a source of compressed gas, a projectile, a guide having a length and including an aperture in fluid communication with an internal chamber, and a sabot slidable along the length of the guide;

releasing compressed gas into a volume bounded in part by a surface of the sabot;

propelling the sabot along the guide by said releasing;

pushing the projectile by the propelled sabot;

venting gas from the volume through the aperture and into the internal chamber; and stopping the sabot along the length of the guide;

wherein the chamber includes a frangible cap, and which further comprises pressurizing the chamber by said venting and fracturing the cap by said pressurizing.

* * * * *